US007857635B2

(12) United States Patent
Goodrich et al.

(10) Patent No.: US 7,857,635 B2
(45) Date of Patent: Dec. 28, 2010

(54) BOARD EDGE TERMINATION BACK-END CONNECTION ASSEMBLIES AND COMMUNICATIONS CONNECTORS INCLUDING SUCH ASSEMBLIES

(75) Inventors: Robert Ray Goodrich, Indianapolis, IN (US); Michael Walter Canning, Plano, TX (US); Amid I. Hashim, Plano, TX (US); Wayne D. Larsen, Wylie, TX (US); Nhan Huynh, Plano, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 47 days.

(21) Appl. No.: 12/365,363

(22) Filed: Feb. 4, 2009

(65) Prior Publication Data

US 2009/0142968 A1 Jun. 4, 2009

Related U.S. Application Data

(63) Continuation-in-part of application No. 11/854,063, filed on Sep. 12, 2007, now Pat. No. 7,503,810.

(60) Provisional application No. 61/096,450, filed on Sep. 12, 2008.

(51) Int. Cl.
*H01R 12/00* (2006.01)

(52) U.S. Cl. ..... 439/76.1; 439/344; 439/418; 439/941

(58) Field of Classification Search ..... 439/76.1, 439/676, 344, 418, 941
See application file for complete search history.

(56) References Cited

U.S. PATENT DOCUMENTS 4,363,941 A * 12/1982 Nelson ..... 439/59
4,725,249 A 2/1988 Blackwood et al.
5,967,801 A 10/1999 Martin et al.
5,971,812 A 10/1999 Martin (Continued)

FOREIGN PATENT DOCUMENTS

DE 102006010279 A1 9/2007

(Continued)

OTHER PUBLICATIONS

Z-Max Product Catalog; www.siemon.com, publication date unknown; copy obtained Jan. 2009.

(Continued)

*Primary Examiner*—Tho D Ta
(74) *Attorney, Agent, or Firm*—Myers Bigel Sibley & Sajovec

(57) ABSTRACT

Communications connectors are provided that include a printed circuit board that has a top side and a bottom side. These connectors each include a housing that receives at least a portion of the printed circuit board. The connectors include first through eighth input contacts that are mounted on the printed circuit board and first through eighth output contacts that are likewise mounted on the printed circuit board. The connectors further include a board edge termination assembly that has an opening that receives an edge of the printed circuit board. The board edge termination assembly has a body that is configured to receive a communications cable having at least eight conductors and to electrically connect the eight conductors to respective ones of the first through eighth output contacts.

29 Claims, 22 Drawing Sheets

U.S. PATENT DOCUMENTS

| | | | | |
|---|---|---|---|---|
| 5,997,358 | A | 12/1999 | Adriaenssens et al. | |
| 6,042,427 | A | 3/2000 | Adriaenssens et al. | |
| 6,139,371 | A | 10/2000 | Troutman et al. | |
| 6,152,754 | A * | 11/2000 | Gerhardt et al. | 439/325 |
| 6,165,023 | A | 12/2000 | Troutman et al. | |
| 6,196,880 | B1 | 3/2001 | Goodrich et al. | |
| 6,244,906 | B1 | 6/2001 | Hashim et al. | |
| 6,267,617 | B1 | 7/2001 | Nozick | |
| 6,283,768 | B1 | 9/2001 | Van Naarden | |
| 6,350,158 | B1 | 2/2002 | Arnett et al. | |
| 6,358,093 | B1 | 3/2002 | Phommachanh et al. | |
| 6,409,547 | B1 | 6/2002 | Reede | |
| 6,443,777 | B1 | 9/2002 | McCurdy et al. | |
| 6,488,525 | B2 | 12/2002 | Abel et al. | |
| 6,565,375 | B1 | 5/2003 | Daoud et al. | |
| 6,592,396 | B2 | 7/2003 | Pepe et al. | |
| 6,746,283 | B2 | 6/2004 | Arnett et al. | |
| 6,752,647 | B1 | 6/2004 | Lin | |
| 6,767,241 | B1 | 7/2004 | Abel et al. | |
| 6,953,362 | B2 | 10/2005 | Mössner et al. | |
| 7,025,621 | B2 | 4/2006 | Mössner et al. | |
| 7,052,307 | B2 | 5/2006 | Kim et al. | |
| 7,201,618 | B2 | 4/2007 | Ellis et al. | |
| 7,229,309 | B2 | 6/2007 | Carroll | |
| 7,335,066 | B2 * | 2/2008 | Carroll et al. | 439/676 |
| 7,604,515 | B2 | 10/2009 | Siemon et al. | |
| 2005/0106946 | A1 | 5/2005 | Doorhy et al. | |
| 2006/0154531 | A1 | 7/2006 | Kim et al. | |
| 2007/0161296 | A1 | 7/2007 | Carroll et al. | |
| 2008/0007372 | A1 | 1/2008 | Carroll | |
| 2008/0160837 | A1 | 7/2008 | Siemon et al. | |
| 2008/0188138 | A1 | 8/2008 | Carroll et al. | |
| 2009/0142968 | A1 | 6/2009 | Goodrich et al. | |
| 2010/0003863 | A1 | 1/2010 | Siemon et al. | |

FOREIGN PATENT DOCUMENTS

| | | | |
|---|---|---|---|
| DE | 10 2006 019 195 | A1 | 10/2007 |
| EP | 1 693 934 | A1 | 2/2006 |
| GB | 234558 | A | 5/2000 |
| WO | 2005/064755 | A1 | 7/2005 |
| WO | 2008/071917 | A1 | 6/2008 |
| WO | 2009/035655 | A1 | 3/2009 |

OTHER PUBLICATIONS

International Search Report and Written Opinion for PCT/US2008/010647, mailed Nov. 13, 2008.

PCT Transmittal of International Search Report and Written Opinion of the International Search Authority for PCT/US2009/055959, dated Feb. 17, 2010.

Invitation to Pay Additional Fees for corresponding PCT/US2009/055959, mailed Nov. 26, 2009.

OptoIQ.com datasheet for Telegartner shielded Cat 6 RJ-45 plug printed Apr. 21, 2009.

Pictures of AMO Category 6 ACO System Outlets.

AMP Category 6 ACO Inserts and Installation Kits Spec sheet.

AMP Communications Outlet (ACO System Plus Spec Sheets (http://nordics.ampnetconnect.com/acoplus.asp).

Color pictures of prior art patch cord with plug that includes a printed circuit board (8 pages).

Color picture of prior art patch cord with plug that includes a printed circuit board (1 page).

Color picture of prior art patch cord with plug that includes a printed circuit board (1 page).

* cited by examiner 320
398
396
397
393
394
392
391
395

320
13
300
396
393
392
391
354
66
63
346
349
348
13
14
340
62
364
61
366
360
330
356
14
60

62
392
320
395
65
340
356
60

BOARD EDGE TERMINATION BACK-END CONNECTION ASSEMBLIES AND COMMUNICATIONS CONNECTORS INCLUDING SUCH ASSEMBLIES

CLAIM OF PRIORITY

The present application claims priority as a continuation-in-part application from U.S. patent application Ser. No. 11/854,063, filed Sep. 12, 2007, now U.S. Pat. No. 7,503,810, and further claims priority from U.S. Provisional Patent Application No. 61/096,450, filed Sep. 12, 2008, the entire contents of both of which are incorporated by reference herein in their entireties.

FIELD OF THE INVENTION

The present invention relates generally to communications connectors and, more particularly, to back-end connection assemblies for communications connectors.

BACKGROUND

Computers, fax machines, printers and numerous other electronic devices are routinely connected by communications cables to network equipment and/or to external networks such as the Internet. FIG. 1 illustrates the manner in which a computer 10 may be connected to network equipment 20 using conventional communications plug/jack connections. As shown in FIG. 1, the computer 10 is connected by a patch cord assembly 11 to a communications jack 30 that is mounted in a wall plate 19. The patch cord assembly 11 comprises a cable 12 that contains a plurality of individual conductors and two communications plugs 13, 14. The communications plug 13 is attached to a first end of the cable 12, and the communications plug 14 is attached to the other end of the cable 12. The communications plug 13 is inserted into a communications jack (not pictured in FIG. 1) that is provided in the back of the computer 10, and the communications plug 14 inserts into a plug aperture 32 in the front side of the communications jack 30. The blades of communications plug 14 (which are exposed through the slots 15 on the top and front surfaces of communications plug 14) mate with respective contacts 41-48 (see FIG. 2) of the communications jack 30 when the communications plug 14 is inserted into the plug aperture 32. The blades of communications plug 13 similarly mate with respective contacts of the communications jack (not pictured in FIG. 1) that is provided in the back of the computer 10.

The communications jack 30 includes a back-end connection assembly 50 that receives and holds conductors from a cable 60. As shown in FIG. 1, each conductor of cable 60 is individually pressed into a respective one of a plurality of slots provided in the back-end connection assembly 50 to establish mechanical and electrical connection between each conductor of cable 60 and the communications jack 30. The other end of each conductor in cable 60 may be connected to, for example, the network equipment 20. The wall plate 19 is typically mounted on a wall (not shown) of a room or office of, for example, an office building, and the cable 60 typically runs through conduits in the walls and/or ceilings of the building to a computer room in which the network equipment 20 is located. The patch cord assembly 11, the communications jack 30 and the cable 60 provide a plurality of signal transmission paths over which information signals may be communicated between the computer 10 to the network equipment 20. It will be appreciated that typically one or more patch panels or switches, along with additional communications cabling, would be included in the electrical path between the cable 60 and the network equipment 20. However, for ease of description, these additional elements have been omitted from FIG. 1 and the cable 60 is instead shown as being directly connected to the network equipment 20.

In most electrical communications systems that are used to interconnect computers, network equipment, fax machines, printers and the like, the information signals are transmitted between devices over a pair of conductors (hereinafter a "differential pair" or simply a "pair") rather than over a single conductor. The signals transmitted on each conductor of the differential pair have equal magnitudes, but opposite phases, and the information signal is embedded as the voltage difference between the signals carried on the two conductors of the pair. When signals are transmitted over a conductor (e.g., an insulated copper wire) in a communications cable, electrical noise from external sources such as lightning, computer equipment, radio stations, etc. may be picked up by the conductor, degrading the quality of the signal carried by the conductor. When the signal is transmitted over a differential pair of conductors, each conductor in the differential pair often picks up approximately the same amount of noise from these external sources. Because approximately an equal amount of noise is added to the signals carried by both conductors of the differential pair, the information signal is typically not disturbed, as the information signal is extracted by taking the difference of the signals carried on the two conductors of the differential pair; thus, the noise signal is cancelled out by the subtraction process.

Currently, high speed communications systems that are used to connect computers and/or other processing devices to local area networks and/or to external networks such as the Internet typically include four differential pairs per communications cable, and thus the four differential pairs necessarily extend in the same direction for some distance. Unfortunately, when multiple differential pairs are bunched closely together, another type of noise referred to as "crosstalk" may arise, which refers to signal energy from a conductor of one differential pair that is picked up by a conductor of another differential pair in the communications system. The induced crosstalk may include both near-end crosstalk (NEXT), which is the crosstalk measured at an input location corresponding to a source at the same location, and far-end crosstalk (FEXT), which is the crosstalk measured at the output location corresponding to a source at the input location. Both types of crosstalk comprise an undesirable noise signal that interferes with the information signal.

FIG. 2 is an exploded perspective view of the communications jack 30 of FIG. 1. As shown in FIG. 2, the communications jack 30 includes a three-piece housing 35, 36, 37. Housing piece 35 defines (at least partly) a plug aperture 32 that is configured to receive a mating communications plug. Housing pieces 36, 37 partially cover and protect a printed circuit board 34. A plurality of jackwire contacts 41-48 are mounted on the printed circuit board 34 so as to extend into the plug aperture 32 from the back of the communications jack 30. However, it will be appreciated that, in other embodiments, some or all of the jackwire contacts 41-48 may extend into the plug aperture 32 from a different direction such as, for example, from the front of the communications jack 30. Each of the jackwire contacts 41-48 terminates into the printed circuit board 34.

The jack 30 further includes a plurality of insulation displacement contacts ("IDCs") 51-58 that are mounted on the printed circuit board 34. As is well known to those of skill in the art, an IDC is a type of wire connection terminal that may be used to make mechanical and electrical connection to an insulated wire conductor. In the communications jack 30, a plurality of electrically conductive paths (not shown in FIG. 2) are provided on the printed circuit board 34. Typically, each of these electrically conductive paths will comprise one or more traces that are disposed on one or more layers of the printed circuit board 34. If the traces of one of the electrically conductive paths are disposed on multiple layers of the printed circuit board 34, the traces on different layers may be interconnected by conductive vias. Each of the electrically conductive paths may provide an electrical path between a respective one of the jackwire contacts 41-48 and a corresponding one of the IDCs 51-58. Housing piece 36 includes a plurality of pillars that define slots which receive the IDCs 51-58. Each slot defined by the pillars is configured to receive a conductor of a communications cable so that the conductor may be inserted into a slot in a respective one of the IDCs 51-58.

FIG. 3 is a perspective view of the communications jack 30 of FIGS. 1-2 with the communications cable 60 terminated thereto. As shown in FIG. 3, the communications cable 60 includes eight insulated conductors 61-68 which are arranged as four differential pairs 71-74. The individual conductors that comprise each differential pair 71-74 are twisted about each other, and all four differential pairs 71-74 are twisted about each other in what is known in the art as a "core twist" (not visible in FIG. 3). The communications cable 60 may also include a separator 69 that separates at least some of the differential pairs 71-74 from other of the differential pairs 71-74, as well as a jacket 70 that encloses and protects the conductors 61-68.

As is also shown in FIG. 3, each of the conductors 61-68 is terminated onto a respective one of the IDCs 51-58. As illustrated in FIG. 2, each IDC 51-58 includes a pair of opposed upwardly extending arms. As shown in FIG. 3, each conductor 61-68 is inserted into the gap between the opposed arms of its corresponding IDC 51-58. The inner edges of the opposed arms cut the insulation on the conductor such that both a mechanical connection and an electrical connection are established between the each conductor 61-68 and its corresponding IDC 51-58. Typically, a technician terminates each conductor 61-68 of cable 60 into the IDCs 51-58 of communications jack 30 by hand at the time that the communications jack 30 is installed in the faceplate 19.

SUMMARY

Pursuant to embodiments of the present invention, communications connectors are provided that include a printed circuit board that has a top side and a bottom side. These connectors include first through eighth input contacts that are mounted on the printed circuit board and first through eighth output contacts that are likewise mounted on the printed circuit board. The connectors further include a board edge termination assembly that has an opening that receives an edge of the printed circuit board. The board edge termination assembly has a body that is configured to receive a communications cable having at least eight conductors and to electrically connect the eight conductors to respective ones of the first through eighth output contacts.

In some embodiments, the board edge termination assembly includes a first cap and/or a second cap. These caps may be pivotable, and may be connected to the body by respective hinges. In certain embodiments, a first subset of the output contacts (e.g., four of eight contacts) may be mounted on the top side of the printed circuit board and a second subset of the output contacts (e.g., the remaining four) may be mounted on the bottom side of the printed circuit board.

In some embodiments, the communications connector may be a communications jack. In such embodiments, each of the plurality of input contacts may be a jackwire contact and each of the plurality of output contacts may be a contact pad. In these embodiments, the board edge termination assembly may include first through eighth contact members that are disposed at least partly within the body, each of which is configured to mate with a respective one of the contact pads. In some embodiments, each of the contact members may have a wire connection terminal portion and a spring contact portion that is configured to mate with a respective one of the contact pads. In some embodiments, the body may include a plurality of recesses, and one of the contact members may be mounted in each recess. The body of the board edge termination assembly may also include an aperture that is configured to receive the communications cable. A plurality of passages may extend between this aperture and a respective one of the recesses.

In some embodiments, the body may have a cable receiving end that includes an aperture that is configured to receive the communications cable and a board mounting end that includes first and second shelves that at least partially define the opening that receives the edge of the printed circuit board. In such embodiments, an interior surface of each of the first and second shelves may include a plurality of slots, and the spring contact portion of a respective one of the contact members may extend through each of these slots. A subset of the contact members (e.g., two, four or six) may be mounted at least partly within the first shelf, and the remaining contact members may be mounted at least partly within the second shelf.

In other embodiments, the communications connector may be a communications plug, and each of the plurality of input contacts is a plug blade, and each of the plurality of output contacts may be an insulation piercing contact. In such embodiments, the board edge termination assembly may include a first cap and a second cap. These caps may be pivotable, and may be connected to the body by respective hinges. Each such pivotable cap may include a plurality of wire passages that are each configured to receive a respective one of the conductors of the communications cable. The board edge termination assembly may also include a separator that is configured to be inserted into the jacket of the communication cable.

Pursuant to further embodiments of the present invention, methods of terminating a communications cable that includes a plurality of differential pairs of conductors to a communications jack are provided. Pursuant to these methods, each of the conductors of the plurality of differential pairs of conductors are terminated into a respective contact member of a board edge termination assembly. Then, the end of the communications cable that includes the board edge termination assembly is routed through the walls of a building to an opening that is configured to receive the communications jack. Next, the communications jack is mated with the board edge termination assembly. Then, the communications jack is inserted into place in the opening that is configured to receive the communications jack. In other embodiments, the communications cable can be routed through the wall to the wall mount location. The board edge termination assembly can be installed onto the end of the communications cable at the wall mount location. Next, the communications jack is connected to the board edge termination assembly and the jack is mounted in the wall mount.

Pursuant to further embodiments of the present invention, communications connectors are provided that include a printed circuit board that has a top side and a bottom side. These connectors each include a housing that receives at least a portion of the printed circuit board. The connectors include first through eighth input contacts that are mounted on the printed circuit board and first through eighth output contacts that are likewise mounted on the printed circuit board. The connectors further include a board edge termination assembly that has an opening that receives an edge of the printed circuit board. The board edge termination assembly has a body that is configured to receive a communications cable having at least eight conductors and to electrically connect the eight conductors to respective ones of the first through eighth output contacts.

In some embodiments, the communications connector may be a communications plug, and the input contacts may be plug blades and the output contacts may be insulation piercing contacts. In such embodiments, four of the insulation piercing contacts may be mounted on the top side of the printed circuit board and another four insulation piercing contacts may be mounted on the bottom side of the printed circuit board. Each plug blade may be implemented as a wire having first and second ends that are mounted in the printed circuit board. These wires may each form a skeletal plug blade. A first side of each plug blade may be substantially normal to the printed circuit board and a second side of each plug blade that is opposite the first side may include a projection in a direction parallel to the plane defined by the top side of the printed circuit board. The projections on adjacent blades may extend in parallel but opposite directions.

Pursuant to further embodiments of the present invention, communications plugs are provided that include a printed circuit board having a top side and a bottom side and eight plug blades. Each plug blade may comprise a wire having a first end mounted in a first opening in the top side of the printed circuit board and a second end mounted in a second opening in the top side of the printed circuit board. Each wire forms a skeletal blade. Eight wire connection contacts are mounted on the printed circuit board, with four of the wire connection contacts mounted on the top side of the printed circuit board and the remaining four wire connection contacts mounted on the bottom side of the printed circuit board.

Pursuant to still further embodiments of the present invention, printed circuit board mountable blades for an RJ-45 style modular plug are provided. These blades comprise a wire having a first end that is configured to be received within a first aperture in the printed circuit board and a second end that is configured to be received within a second aperture in the printed circuit board. The wire forms a skeletal plug blade, and is shaped so that the plug blade includes a projection in a direction parallel to a plane defined by the top side of the printed circuit board. In some embodiments, the skeletal plug blade may comprise a planar plug blade that extends in a direction parallel to a longitudinal axis of the printed circuit board. In such embodiments, the projection may likewise extend in a direction parallel to a longitudinal axis of the printed circuit board. In certain embodiments, the wire may include a generally vertical segment, a generally horizontal segment, a first transition segment, a generally U-shaped projection segment and a second transition segment, where ends of the generally vertical segment are directly connected to the first end of the wire and to the first transition segment, respectively, ends of the generally horizontal segment are directly connected to the first transition segment and to the generally U-shaped projection segment, respectively, and ends of the generally U-shaped projection segment are directly connected to the generally horizontal segment and to the second transition segment.

DETAILED DESCRIPTION

Figure 1:
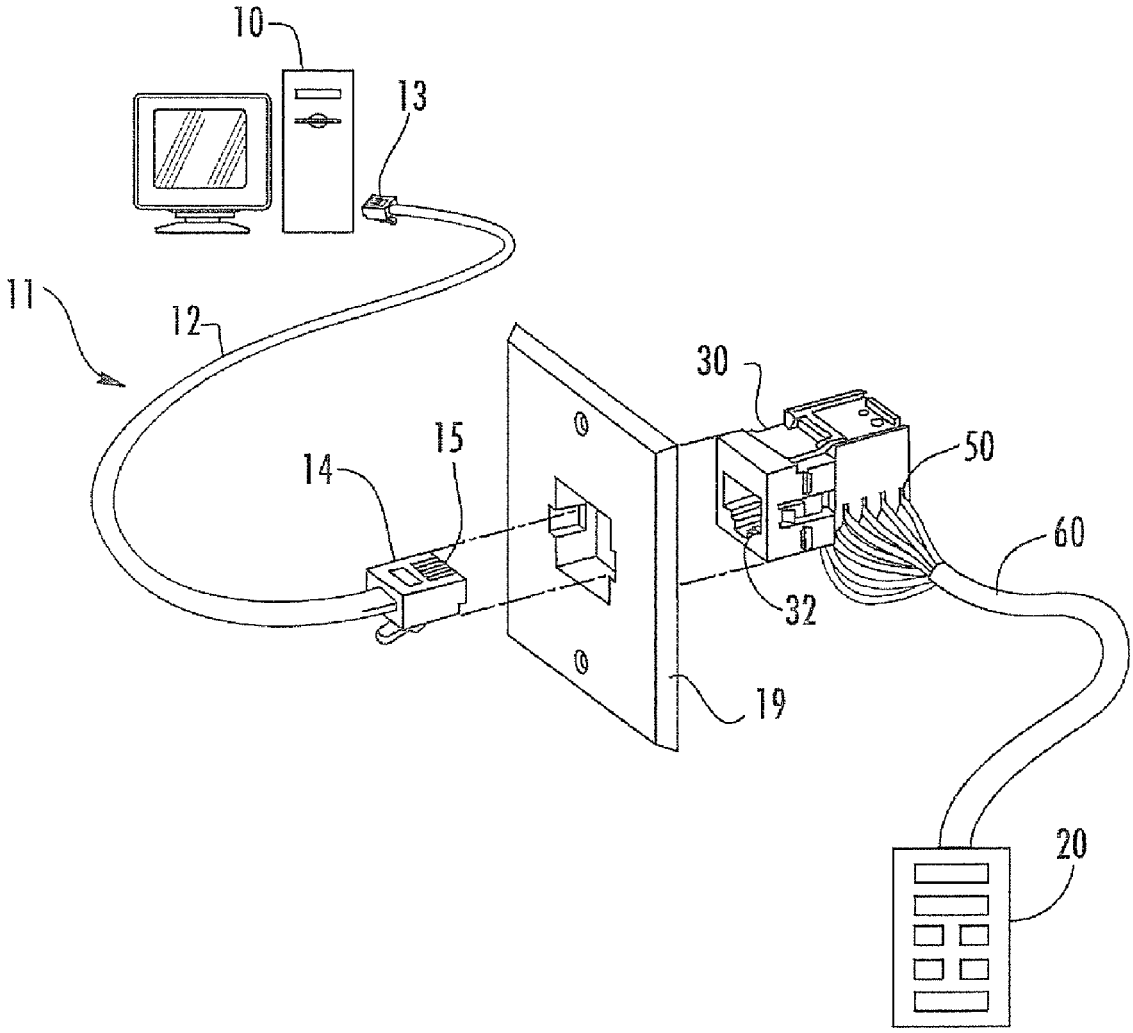
FIG. 1 (PRIOR ART)
FIG. 1 is a schematic drawing that illustrates the use of communications plug/jack connectors to connect a computer to network equipment.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

This invention is directed to communications connectors, with the primary examples of such connectors being a communications jack and a communications plug. As used herein, the terms "forward", "forwardly", and "front" and derivatives thereof refer to the direction defined by a vector extending from the center of a communications jack toward the plug opening of the jack or from the center of a communications plug toward the plug blades. Conversely, the terms "rearward", "rearwardly", and derivatives thereof refer to the direction directly opposite the forward direction; the rearward direction is defined by a vector that extends away from the plug opening toward the remainder of the communications jack or from the plug blades toward the remainder of the communications plug. The term "horizontal" is used to refer to planes that are generally parallel to the plane defined by the base of the plug opening of a communications jack, or, in a communications plug, to a plane that is parallel to the surface of the plug housing that includes the plug latch, while the term "vertical" is used to refer to planes that are generally parallel to the front face of the plug opening of a communications jack or parallel to front face of a communications plug (i.e., the face that is inserted into the plug opening of a communications jack). The terms "laterally" and "transversely" are used to refer to movement in a horizontal plane. Where used, the terms "attached", "connected", "interconnected", "contacting", "mounted" and the like can mean either direct or indirect attachment or contact between elements, unless stated otherwise.

Figure 4:
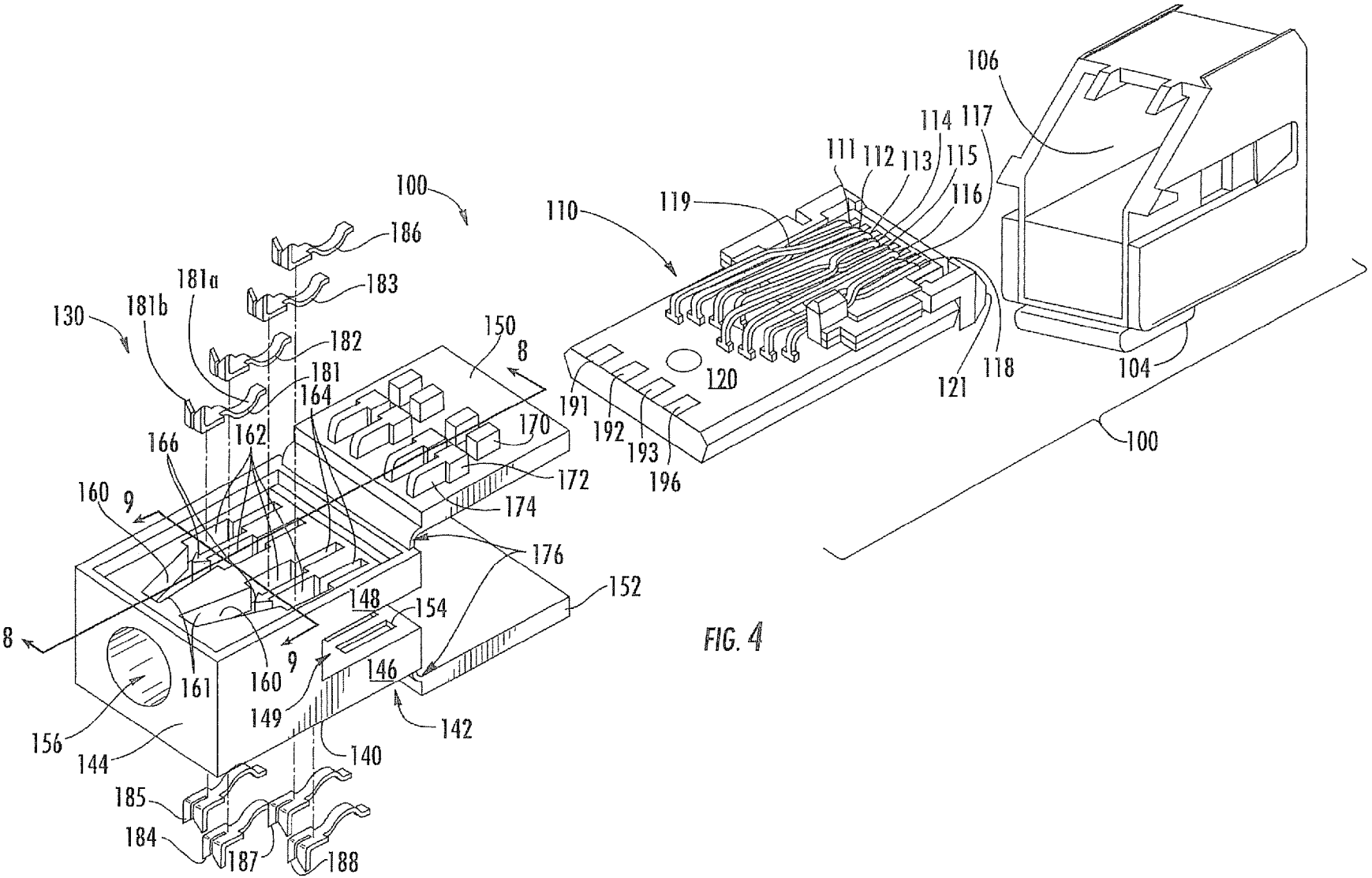
FIG. 4 is an exploded perspective view of a communications jack that includes a board edge termination assembly according to embodiments of the present invention.
Figure 5:
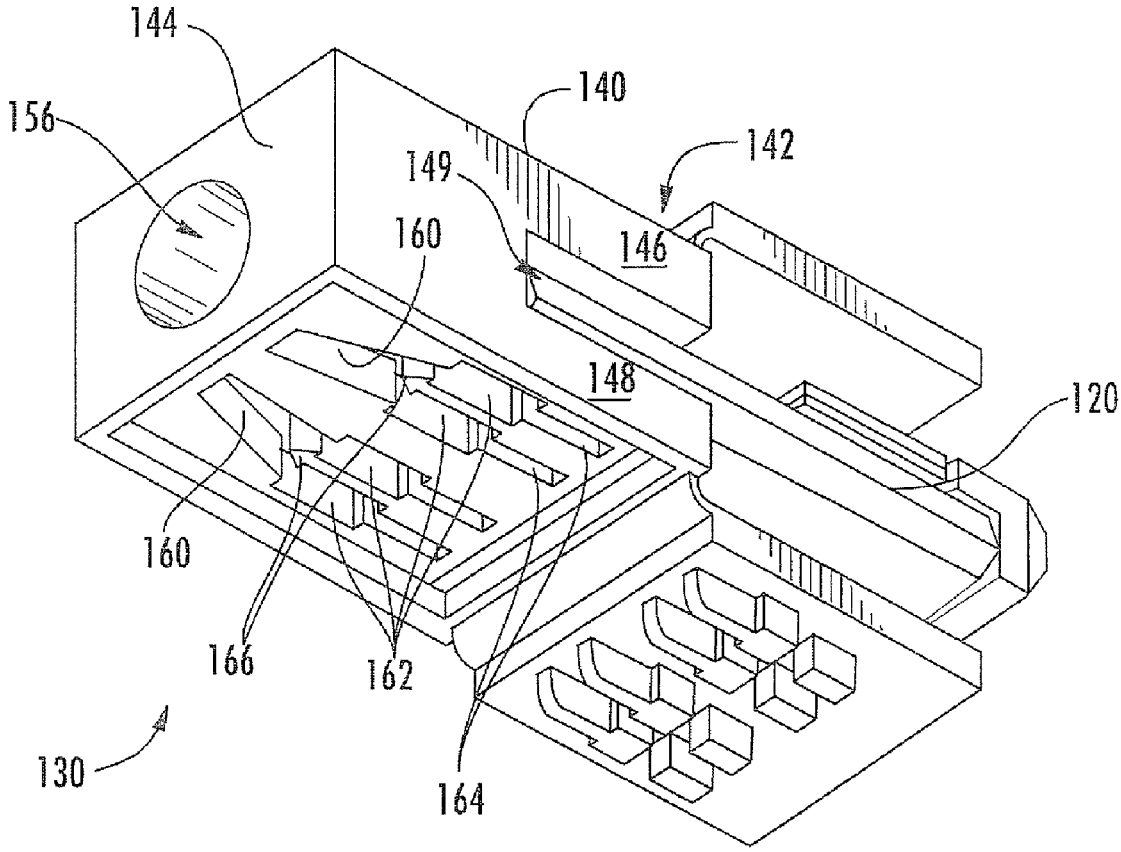
FIG. 5 is a perspective view of the board edge termination assembly of FIG. 4.

FIGS. 4-10 depict a communications jack 100 according to some embodiments of the present invention. In particular, FIG. 4 is an exploded perspective view of a communications jack 100 according to embodiments of the present invention that includes a board edge termination assembly 130. FIG. 5 is a perspective view of the board edge termination assembly 130 of FIG. 4 with the communications insert 110 inserted into the board edge termination assembly 130. As shown in FIG. 4, the communications jack 100 includes a jack frame 104 having a plug aperture 106 for receiving a mating plug (the mating plug is not shown in FIG. 4), a communications insert 110 that includes input contacts 111-118, and a board edge termination assembly 130. Any conventional jack frame 104 may be used, and hence the jack frame 104 is not described in detail herein. In the embodiment of FIGS. 4-10, the jack frame 104 comprises the entire housing for the communications jack 100. However, it will be appreciated that in other embodiments the housing may include additional and/or different components that at least partially surround and protect various components of the communications jack and/or which serve to define the plug aperture 106. It will also be appreciated that the communications jack 100 of FIGS. 4-10 would typically be inverted when installed so that the input contacts 111-118 are suspended into an upper portion of the plug aperture 106, as such an orientation can reduce buildup of dust and dirt on the input contacts 111-118 that may degrade the electrical connection between the plug blades and the input contacts 111-118.

The communications insert 110 is received into an opening in the rear of the jack frame 104. The communication insert 110 may snap into place or otherwise be adhered or fixed to the jack frame such that the communication insert 120 is fixedly mounted within the jack frame. The communications insert 110 includes a printed circuit board 120, which may be formed of conventional materials. Specialized printed circuit boards such as, for example, flexible printed circuit boards may also be used. In the embodiment of the present invention depicted in FIGS. 4-10, the printed circuit board 120 comprises a multi-layer printed circuit board that is substantially planar. As shown in FIG. 4, the input contacts 111-118 may comprise conventional spring jackwire contacts that are configured to mate with the respective blades of a mating communications plug such as, for example, the jackwire contacts described in U.S. Pat. No. 6,350,158. The jackwire contacts may include crossovers and/or bends that are designed to reduce crosstalk and/or introduce compensatory crosstalk. Moreover, in certain embodiments of the present invention, other types of input contacts 111-118 may be used such as, for example, jackwire contacts that are formed as part of a flexible printed circuit board. In the embodiment of FIGS. 4-10, the eight jackwire contacts 111-118 are mounted on a top surface of the printed circuit board 120. Each of the jackwire contacts 111-118 has a termination end that is mounted in a central portion of the printed circuit board 120, and a distal end that terminates underneath a mandrel that is mounted adjacent a forward portion of the top surface of the printed circuit board 120. Each of the jackwire contacts 111-118 extends into the plug aperture 106 to make physical and electrical contact with the blades of a mating communications plug (not shown). In this particular embodiment, the distal end 111-118 of each contact is a "free" end that is not mounted in the printed circuit board 120 or in another substrate, and hence can deflect when the communications plug is inserted into the plug aperture 106 of communications jack 100.

Each jackwire contact 111-118 may be mounted to the printed circuit board 120 via insertion into a respective metal-plated aperture (not shown in FIG. 4) in the printed circuit board 120. Each jackwire contact 111-118 may be interference fit within its respective aperture. In the embodiment of FIG. 4, the apertures are arranged in a "dual diagonal" pattern known to those skilled in this art as described in U.S. Pat. No. 6,196,880 to Goodrich et al. The jackwire contacts 111-118 may have substantially the same profile, as shown in FIG. 4, and may be substantially transversely aligned in side-by-side relationship. Likewise, the jackwire contacts 111-118 may include crossovers such as crossover 119. However, it will be appreciated that any jackwire contact configuration may be used. Thus, in other embodiments of the present invention, the jackwire contacts 111-118 may, for example, have different profiles, may not be in a generally side-by-side relationship (except in the "contact" region where the jackwire contacts physically contact a mating communications plug to the extent required by industry standards), may or may not include one or more crossovers, and may be oriented differently with respect to the printed circuit board.

The communications insert 110 also includes a plurality of output contacts 191-198 (only output contacts 191-193 and 196 are visible in FIG. 4; output contacts 194-195 and 197-198 are provided on the bottom side of the rear portion of the printed circuit board 120 so as to be aligned with channels 164 in FIG. 5). Contacts 191-198 are referred to herein as "output contacts" because they are the contacts that are used to electrically connect a plurality of conductive paths on the printed circuit board 120 to the respective conductors of a communications cable that connects to the back end of the communications jack 100. This is in contrast to the "input contacts" 111-118, which are the contacts that are used to electrically connect the conductive paths on the printed circuit board 120 to the respective blades of a mating communications plug. In the particular embodiment of the present invention depicted in FIG. 4, the output contacts 191-198 comprise contact pads that are provided on the top and/or bottom surface of the printed circuit board 120, typically adjacent the rear edge of the printed circuit board 120. Each contact pad 191-198 may comprise a conductive element that mates with a respective contact member provided in the board edge termination assembly 130 (described below) so as to electrically connect the contact member in the board edge termination assembly 130 to one of the conductive paths on the printed circuit board 120. The contact pads 191-198 may, for example, comprise immersion tin plated copper pads, gold plated pads, small gold plated nail heads, carbon ink pads, etc. In other embodiments of the present invention, different types of output contacts may be used such as, for example, metal wires or IDCs.

As noted above, a conductive path extends between each jackwire contact 111-118 and a respective one of the contact pads 191-198. Each conductive path may comprise, for example, one or more conductive traces that are provided on one or more layers of the printed circuit board 120. When a conductive path includes conductive traces that are on multiple layers of the printed circuit board 120, metal-plated or metal-filled through holes (or other layer-transferring structures known to those skilled in this art) may be provided that provide an electrical connection between the conductive traces on different layers of the printed circuit board 120. The conductive traces may be formed of conventional conductive materials such as, for example, copper, and may be deposited on the printed circuit board 120 via any deposition method known to those skilled in this art to be suitable for the application of conductors.

As noted above, the communications jack further includes a board edge termination assembly 130. A "board edge termination assembly" refers to an assembly (note that the assembly may, in some embodiments, comprise a one piece assembly) that mates with a printed circuit board of a communications connector so as to electrically connect the conductors of a communications cable to the printed circuit board. In some embodiments, the assembly may be detachable. As shown in FIG. 4, the board edge termination assembly 130 includes a body 140 and a plurality of contact members 181-188. The body 140 includes a forward portion 142 and a rear portion 144. The forward portion 142 includes first and second spaced apart shelves 146, 148. The shelves 146, 148 define an opening 149 therebetween which receives the rear edge of printed circuit board 120. The rear portion 144 includes an aperture 156 that may receive a communications cable 60 (not pictured in FIG. 4) that is to be connected to the communications jack 100. It will be appreciated that the shelves 146, 148 may take on a wide variety of shapes, need not be generally flat or elongated, may each be formed of multiple pieces, etc. By way of example, in an alternative embodiment the shelves 146, 148 may each simply comprise two narrow prongs or protrusions, and the printed circuit board 120 is received between the protrusions of such shelves 146, 148. Numerous other shelf designs are possible. The board edge termination assembly 130 may be formed of, for example, polycarbonate, ABS, ABS/polycarbonate blend or like dielectric molded materials.

Figure 3:
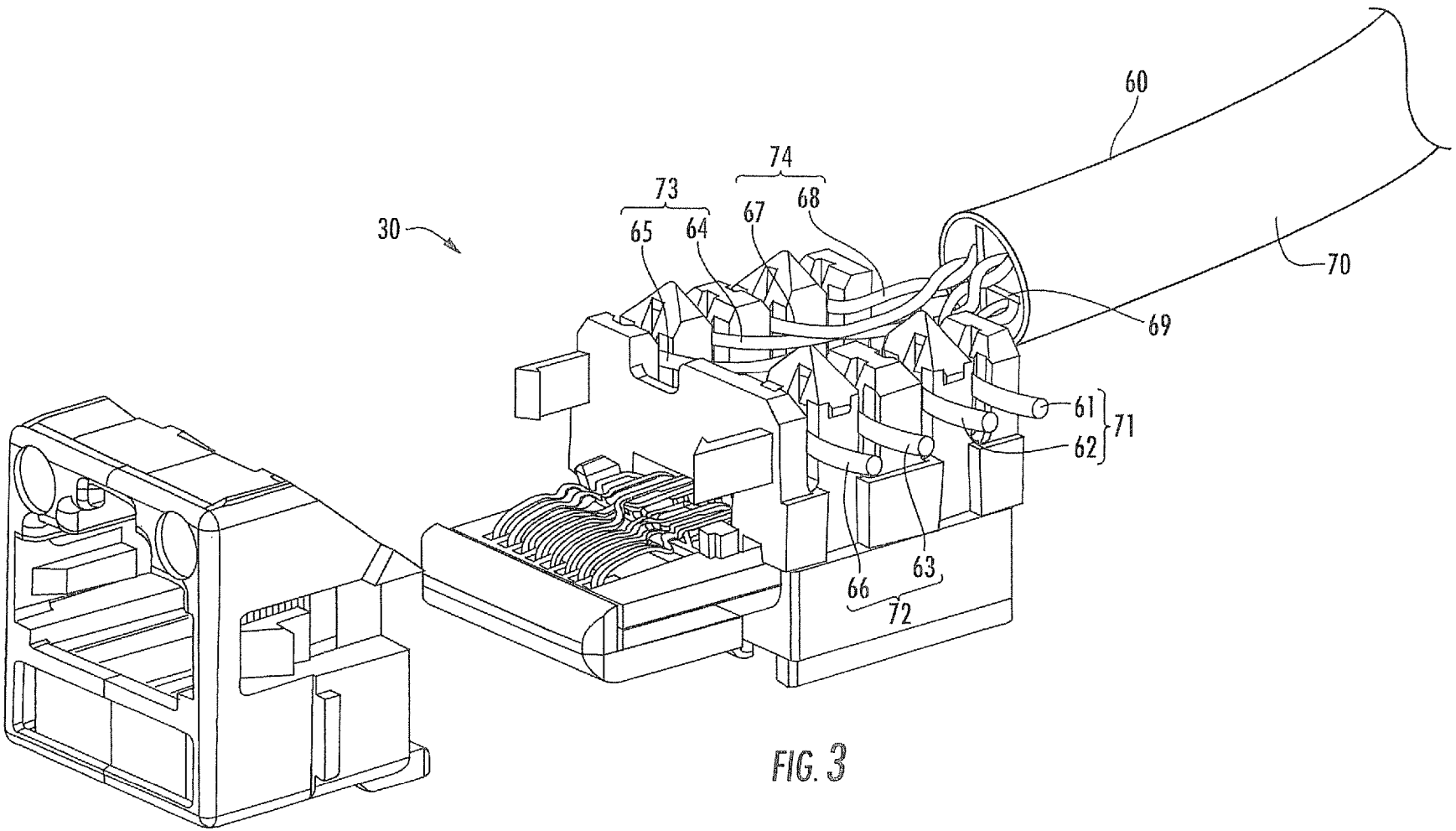
FIG. 3 is a perspective view of the communications jack of FIGS. 1 and 2 with a communications cable terminated thereon.

As shown in FIGS. 4-5, the top and bottom surfaces of the body 140 each include two recessed areas 160. The rear portion 161 of each recessed area 160 is connected by a passage such as a channel or an opening (not visible in FIGS. 4-5) to the aperture 156 which receives the communication cable. As discussed above with respect to FIG. 3, the communications cable 60 includes eight insulated conductors 61-68 which are arranged as four differential pairs 71-74. The individual conductors that comprise each differential pair 71-74 (i.e., conductors 61/62, 63/66, 64/65 and 67/68 according to industry standardized wiring schemes, see, e.g., TIA/EIA-586-B.2.1 standard approved Jun. 20, 2002 and the related standards referenced therein) are twisted about each other, and all four differential pairs 71-74 are twisted about each other in a "core twist." The end of each of the conductors 61-68 is passed through a respective one of the above-mentioned passages that connect aperture 156 and each recessed area 160 into the rear portion 161 of each recessed area 160. This is more clearly illustrated in FIG. 6 and the discussion thereof herein.

Each recessed area 160 further includes a twist terminator 166 that may be used to consistently set the location where the differential pairs 71-74 received within the respective recessed areas 160 switch from a twisted to an untwisted configuration. In the embodiment depicted in FIGS. 4-10, the twist terminator 166 includes a pointed, or knife-like, ridge that may help a technician to separate the individual conductors 61-68 within each differential pair 71-74. Each recessed area 160 further includes a pair of cavities 162 that are separated by a vertical wall. Each recessed area 160 also includes a pair of channels 164 that extend from respective forward portions of the cavities 162.

As is also shown in FIGS. 4-5, the board edge termination assembly 130 includes a plurality of contact members 181-188. The contact members 181-188 may comprise any conductive elements that electrically connect the conductors of a communications cable such as communications cable 60 to respective one of a plurality of conductive paths on the printed circuit board 120 of communications jack 100. For example, in some embodiments, the contact members 181-188 may comprise contact "wires" (which may be round or, more typically, formed of thin pieces of stamped metal) that each include a spring contact portion 181*a*-188*a* (i.e., a deflectable portion that is designed to make mechanical and electrical connection with a corresponding contact or contact pad) and a wire termination portion 181*b*-188*b* (i.e., a portion to which a wire or other conductor may be terminated or attached). As shown more clearly in FIG. 8, the spring contact portion 181*a*-188*a* in some embodiments of the present invention may comprise an elongate strip of stamped metal which is formed into a curved or arcuate shape. The end of the spring contact portion 181*a*-188*a* of each contact member 181-188 may be unrestrained (i.e. each end constitutes a "free" end) so that the spring contact portion may deflect and create a spring force when a force is applied to the curved or arcuate section 181*a*-188*a*. The wire termination portion 181*b*-188*b* may comprise, for example, an IDC that receives an insulated conductor and cuts the insulation to make both mechanical and electrical connection with the conductor. As shown in FIGS. 4-5, each cavity 162 in body 140 of board edge termination assembly 130 is configured to receive the wire termination portion 181*b*-188*b* of one of the contact members 181-188. Likewise, each channel 164 is configured to receive the spring contact portion 181*a*-188*a* of a respective one of the contact members 181-188.

Figure 8:
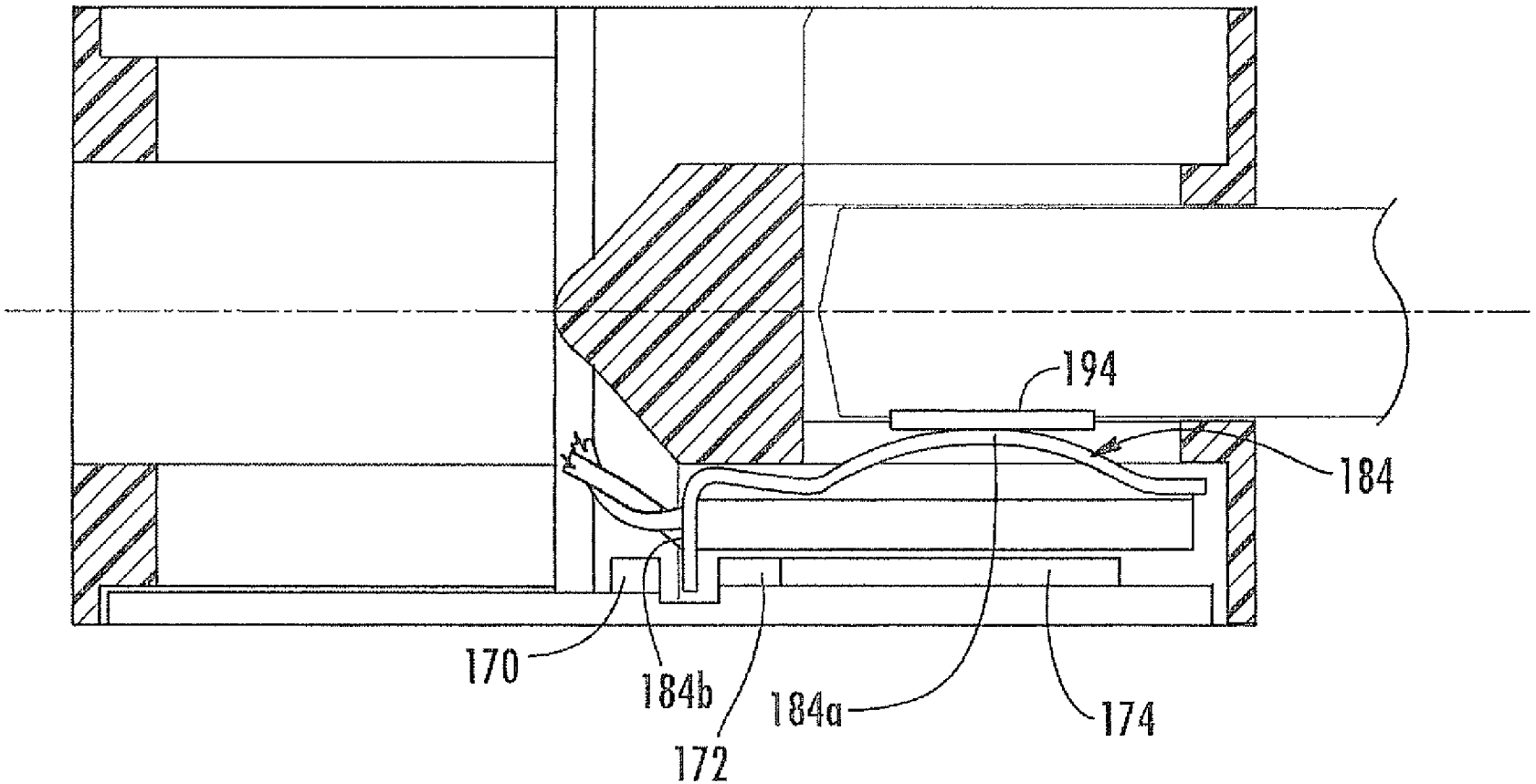
FIG. 8 is a cross-sectional view of the board edge termination assembly taken along the line 8-8 of FIG. 4 once the board edge termination assembly has been closed into the configuration of FIG. 7.

First and second pivotable caps 150, 152 are connected to forward portion 142 of body 140. As shown in FIG. 4, each pivotable cap 150, 152 connects to a respective one of the shelves 148, 146 by a respective hinge 176. Each pivotable cap 150, 152 includes a plurality of first protrusions 170, a plurality of second protrusions 172 and a plurality of third protrusions 174 on an inner face thereof. As shown in FIGS. 4 and 8, the pivotable caps 150, 152 are designed so that, when moved to a closed position by pivoting each cap 150, 152 about its respective hinge so that the caps 150, 152 close over the respective upper and lower surfaces of the body 140, each of the plurality of first protrusions 170 will reside within the rear portion 161 of one of the recessed areas 160 just outside of one of the cavities 162. Similarly, the pivotable caps 150, 152 are designed so that, when in a closed position, each of the plurality of second protrusions 172 will reside within a respective one of the cavities 162, and each of the plurality of third protrusions 174 will reside within a respective one of the channels 164. As will be discussed in more detail herein, with this configuration the pivotable caps 150, 152 may serve as stuffer caps that hold the contact members 181-188 in place and seat respective conductors 61-68 from communication cable 60 in the respective wire termination portions 181*b*-188*b* of each contact member 181-188 (see discussion below). As shown in FIGS. 4-5, the pivotable caps 150, 152 may have substantially the same design except that the locations of the protrusions 170, 172, 174 may be offset on the two caps 150, 152, as discussed in more detail herein, for purposes of potentially providing improved crosstalk performance in certain embodiments of the present invention.

Figure 6:
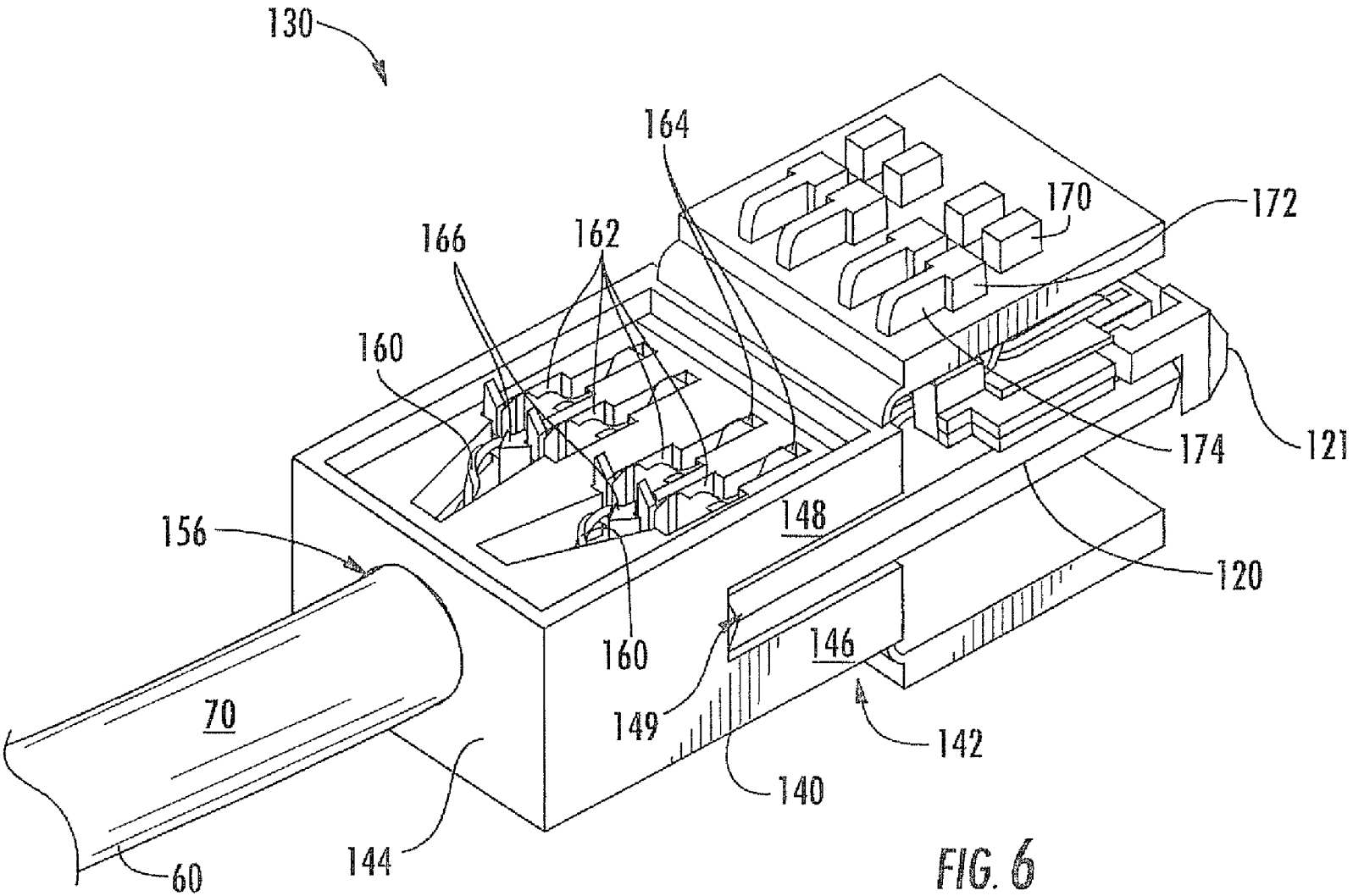
FIG. 6 is a perspective view of the board edge termination assembly of FIG. 4 with a communications cable partially terminated thereon.

FIG. 6 is a perspective view of the board edge termination assembly 130 of FIGS. 4-5 with the communications cable 60 terminated thereon (except for the closing of the pivotable caps 150, 152). As shown in FIG. 6, one end of the communications cable 60 is inserted into the aperture 156. While the jacket 70 of cable 60 will typically be removed from the endmost portion of communications cable 60 in order to allow access to each of the differential pairs of conductors included in communications cable 60, the jacket 70 may remain on the portion of communications cable 60 that extends into aperture 156. Moreover, while not shown in the figures, a cable strain relief mechanism such as, for example, an anchor bar that engages the jacketed cable and firmly holds the jacketed cable against a strain relief housing, or a compressible wedge collar that surrounds the jacketed cable and pinches against the jacketed cable when snapped into an associated strain relief housing, may be included in the rear portion 144 of body 140. Once the communications cable 60 is inserted into aperture 156, this cable strain relief mechanism may be locked into place against the jacket 70 in order to provide strain relief in the event that communications cable 60 is pulled after the board edge termination assembly 130 is attached thereto. By having the cable strain relief mechanism contact a jacketed portion of the communications cable 60, it may be possible to better maintain each differential pair in its proper position within the cable, which may help reduce the overall crosstalk levels.

As is further shown in FIG. 6, each differential pair 71-74 of conductors 61-68 passes through a respective one of the passages that connect each recessed area 160 to the aperture 156 (only two of the differential pairs are visible in FIG. 6; the other two pairs would be placed in the openings 160 on the reverse side of body 140). In the rear portion 161 of each recessed area 160 the conductors 61-68 of each respective differential pair 71-74 may remain twisted together. Each twist separator 166 may be used to define the region where each respective differential pair 71-74 transitions from a twisted to an untwisted state. The untwisted end of each conductor 61-68 is placed over the wire termination portion 181*b*-188*b* of a respective one of contact members 181-188. The conductor 61-68 may then be lodged into place between the opposed arms of the wire termination portion 181*b*-188*b* of the contact member 181-188 by either hand manipulation of the conductor or by pivoting the appropriate pivotable cap 150, 152 into its closed position such that the first and second protrusions 170, 172 force each conductor 61-68 into place between the opposed arms of the wire termination portion 181*b*-188*b* of its respective contact member 181-188.

The use of board edge termination assembly 130 or other board edge termination devices according to embodiments of the present invention may allow an installer to seat the conductors 61-68 of each of the differential pairs 71-74 into the wire connection terminals 181*b*-188*b* of the communications jack 100 independent of the location of the communications jack 100. Thus, for example, an installer may pre-terminate a large number of communications cables at a desk or work area by, for example, using the wire termination procedure discussed above with respect to FIG. 6 to terminate each communications cable into a respective board edge termination assembly 130, then later snap each board edge termination assembly 130 of each pre-terminated communications cable into place on the end of a communications jack 100. This ability to terminate the communications cable at a location separate from the location of the communications jack may be more convenient for the installer, since communications jacks are often located in areas that only provide limited access to the communications jack such as in patch panels or wall plates.

Figure 11A:
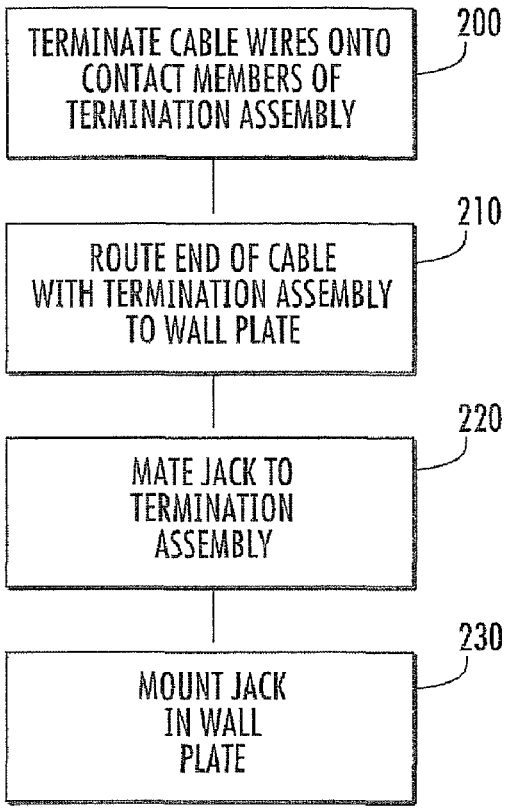
FIGS. 11A and 11B are flow charts detailing operations for terminating a communications cable that includes a plurality of differential pairs of conductors to a communications jack according to certain embodiments of the present invention.

FIG. 11A illustrates a method of terminating a communications cable that includes a plurality of differential pairs of conductors to a communications jack according to certain embodiments of the present invention. As shown in FIG. 11A, operations may begin with a technician or installer terminating each of the conductors of the plurality of differential pairs of conductors into a respective contact member of a board edge termination assembly (block 200). In many cases, a large number of cables will be terminated onto respective board edge termination assemblies at one time, at a location remote from the location(s) where the communications jacks will actually be mounted. In some cases, predetermined lengths of communications cables may be terminated onto the board edge assemblies at the factory with precut lengths of cable. Next, the end of the communications cable that includes the board edge termination assembly is routed through the walls and/or ceiling, or office furniture raceways and partitions, of a building to (and possibly through) an opening that is configured to receive the communications jack (block 210). Next, the communications jack and the board edge termination assembly are mated together by, for example, inserting the printed circuit board of the communications jack into an opening in the board edge termination assembly (block 220). Finally, the communications jack with the mated board edge termination assembly may be inserted into place in the opening that is configured to receive the communications jack (block 230). Note that in order to facilitate such operations, the board edge termination assembly may need a smaller cross-section than does a jack housing of the communications jack so that the board edge termination assembly may fit through the opening in the wall plate that receives the communications jack.

Figure 11B:
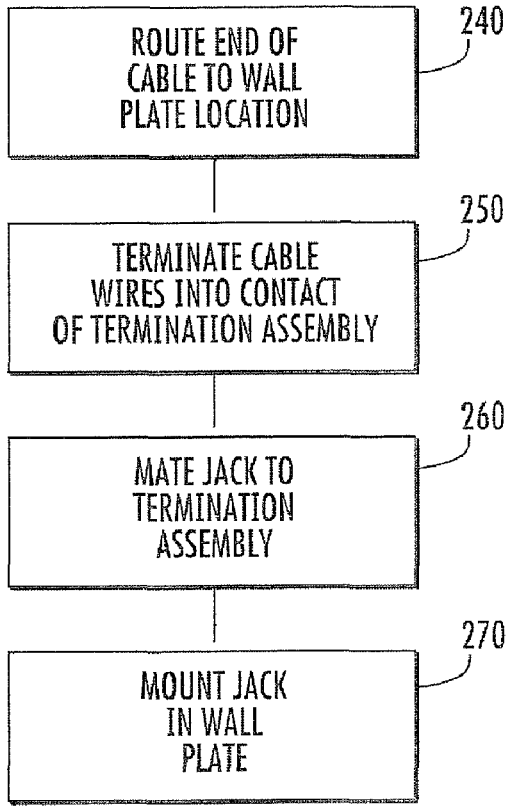

FIG. 11B illustrates methods of terminating a communications cable that includes a plurality of differential pairs of conductors to a communications jack according to further embodiments of the present invention. As shown in FIG. 11B, operations may begin with a technician or installer routing an end of each cable through the walls, ceiling, office furniture raceways and/or partitions to respective wall mount locations (block 240). Next, the technician terminates each of the cables onto its respective communication jack by terminating each conductor of each cable into a respective contact member of a board edge termination assembly that is associated with each respective communication jack (block 250). Next, the communications jack and the board edge termination assembly are mated together by, for example, inserting the printed circuit board of the communications jack into the opening in the board edge termination assembly (block 260). Finally, the communications jack with the mated board edge termination assembly may be inserted into place in the opening that is configured to receive the communications jack (block 270).

Other installation procedures may be used when, for example, installing communications jacks in closet racks. Several communications jacks can be snapped into the racks. The board edge termination assembly can be attached to each cable. Next, each board edge termination assembly can be plugged onto the back end of a respective one of the pre-installed communications jacks.

Figure 7:
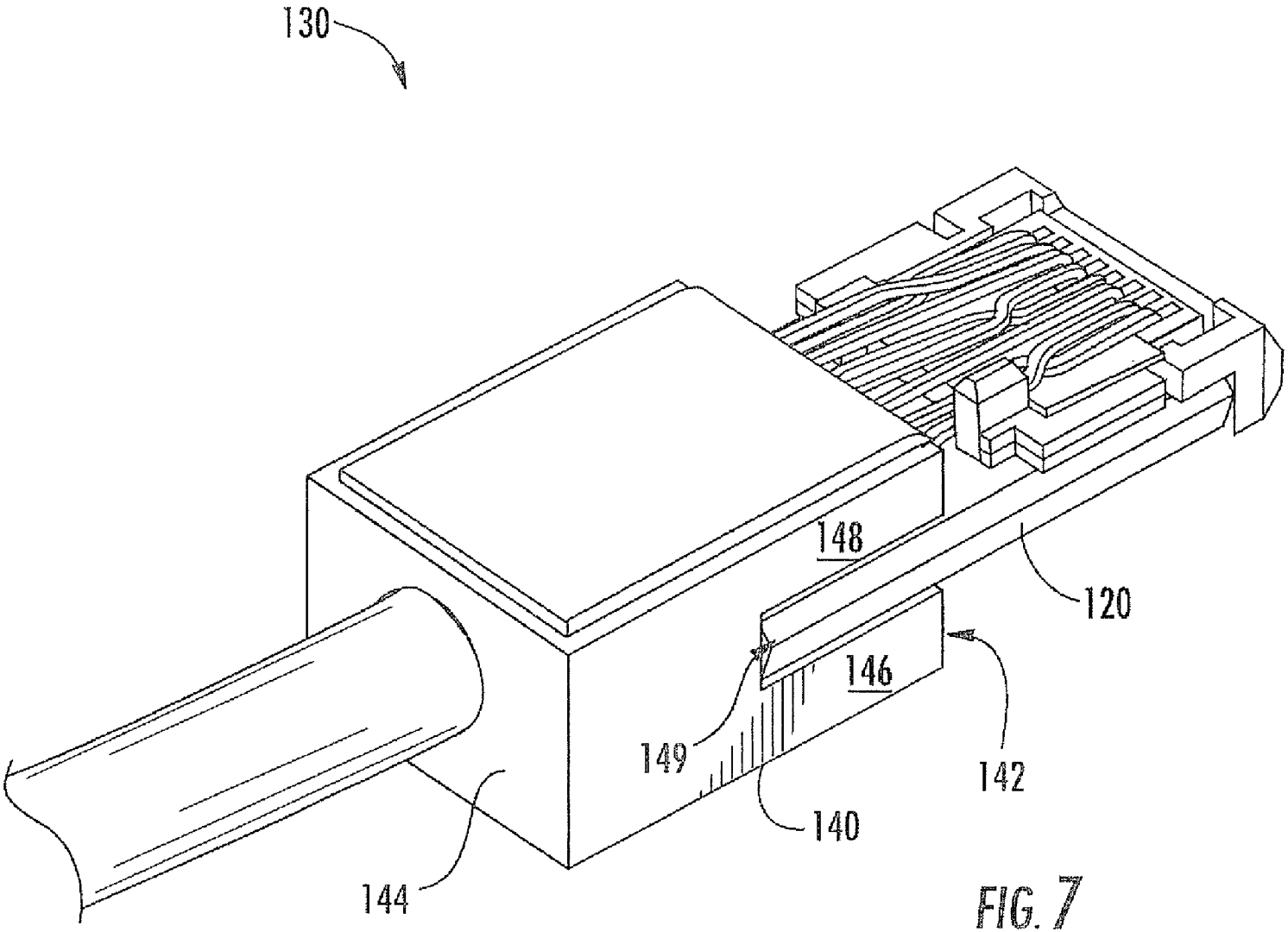
FIG. 7 is a perspective view of the communications jack of FIG. 4 with the board edge termination assembly installed thereon.

FIG. 7 is a perspective view of the communications jack of FIG. 4 after all of the conductors 61-68 of cable 60 have been terminated into their respective contact members 181-188, and after the pivotable caps 150, 152 have been moved into their closed positions. While not shown in FIG. 7, releasable snap clips, latches or other connection mechanisms may be provided on body 140 and/or on pivotable caps 150, 152 so that pivotable caps 150, 152 are held securely in place once pivoted into their closed positions. The protrusions 170, 172, 174 on pivotable caps 150, 152 may act to securely hold contact members 181-188 and/or conductors 61-68 of communications cable 60 in place once the pivotable caps 150, 152 are pivoted into their respective closed positions. In FIG. 7, the board edge termination assembly 130 has also been moved into place over the rear edge of printed circuit board 120 so that each contact member 181-188 makes mechanical and electrical connections with a respective one of the contact pads 191-198 as discussed in more detail below with respect to FIG. 8. As shown in FIG. 7, the rear edge of printed circuit board 120 fits into the opening 149 defined between the shelves 146, 148 of board edge termination assembly 130. In some embodiments of the present invention, the board edge termination assembly 130 may be configured or keyed to a feature on printed circuit board 120 (e.g. a slot) such that it will only fit over the rear edge of printed circuit board 120 in one orientation so that an installer may not mistakenly install board edge termination assembly 130 onto printed circuit board 120 upside down (which could terminate the conductors 61-68 to the wrong contact pads 191-198 or result in electrical open circuits). Releasable snap clips or other latching or connecting mechanisms (not shown in FIGS. 4-7) may also be provided that securely connect the board edge termination assembly 130 to the rear of the communications jack 100.

FIG. 8 is a cross-sectional view of the board edge termination assembly 130 taken along the line 8-8 of FIG. 4 once the board edge assembly has been closed into the configuration of FIG. 7. As can be seen, FIG. 8 provides a cross-sectional view of contact member 184, and shows how contact member 184 makes mechanical and electrical connections to corresponding contact pad 194 on printed circuit board 120. As discussed above, contact member 184 includes a wire termination portion 184*b* and a spring contact portion 184*a*. As shown best in FIG. 4, the inner surface of each shelf 146, 148 includes a plurality of slots 154. The spring contact portions 181*a*-188*a* of each contact member 181-188 extend through a respective one of these slots 154 into the opening 149 between shelves 146, 148. As illustrated in FIG. 8, when the board edge termination assembly 130 is placed over the back end of the printed circuit board 120, the spring contact portions 181*a*-188*a* of contact members 181-188 deflect away from the printed circuit board. This deflection is made possible since the far end of the spring contact portions 181*a*-188*a* is not mounted in the body 140 and is free to move normally relative the surface of the printed circuit board 120. Each spring contact portion 181*a*-188*a* is positioned so that when the printed circuit board 120 is inserted into opening 149, the spring contact portion 181*a*-188*a* is both laterally and vertically aligned with one of the contact pads 191-198 that are provided on the upper or lower surfaces of the rear of printed circuit board 120. Each spring contact portion 181*a*-188*a* of contact members 181-188 "wipes" against its respective contact pad 191-198. This "wiping action" facilitates clearing away dust or dirt that may be present on the contact pad 191-198, thus providing for good mechanical and electrical connection between each contact member 181-188 and its corresponding contact pad 191-198.

Figure 9:
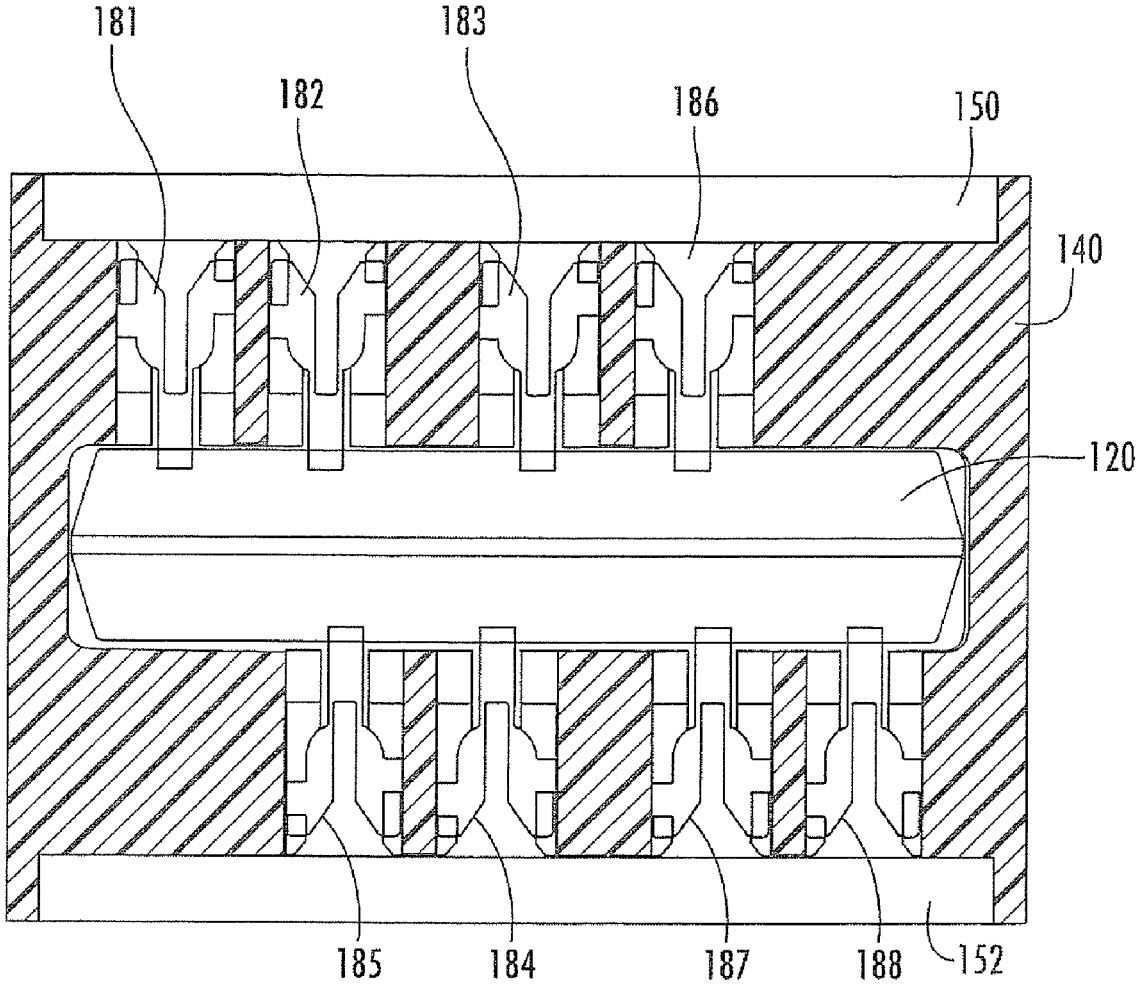
FIG. 9 is a cross-sectional view of the board edge termination assembly taken along the line 9-9 of FIG. 4 once the board edge termination assembly has been closed into the configuration of FIG. 7.

FIG. 9 is a cross-sectional view of the board edge termination assembly 130 taken along the line 9-9 of FIG. 4 once the board edge assembly has been closed into the configuration of FIG. 7. As shown in FIG. 9, contact members 181-183 and 186, which mate with the contact pads 191-193 and 196 that are on the top surface of printed circuit board 120, are not transversely aligned with contact members 184-185 and 187-188, which mate with the contact pads 194-195 and 197-198 that are on the bottom surface of printed circuit board 120. In particular, contact members 181, 182, which are part of a first differential pair, are positioned above the far left side of printed circuit board 120, contact members 183, 186, which are part of a second differential pair, are positioned above the right-central portion of printed circuit board 120, contact members 184, 185, which are part of a third differential pair, are positioned below the left-central region of printed circuit board 120, and contact members 187, 188, which are part of a fourth differential pair, are positioned below the far right side of printed circuit board 120. As will be explained in further detail below, this configuration may facilitate reducing the amount of crosstalk introduced in the board edge termination assembly 130 of communications jack 100.

In order to simplify the drawings, the contact members 181-188 are shown as being generally linear. However, it will be appreciated that the arrangement of the wire termination portions **181*b*-188*b*, for example, may make it desirable or necessary to use non-linear contact members 181-188** that, for example, include one or more "jogged" or angled sections.

Figure 10:
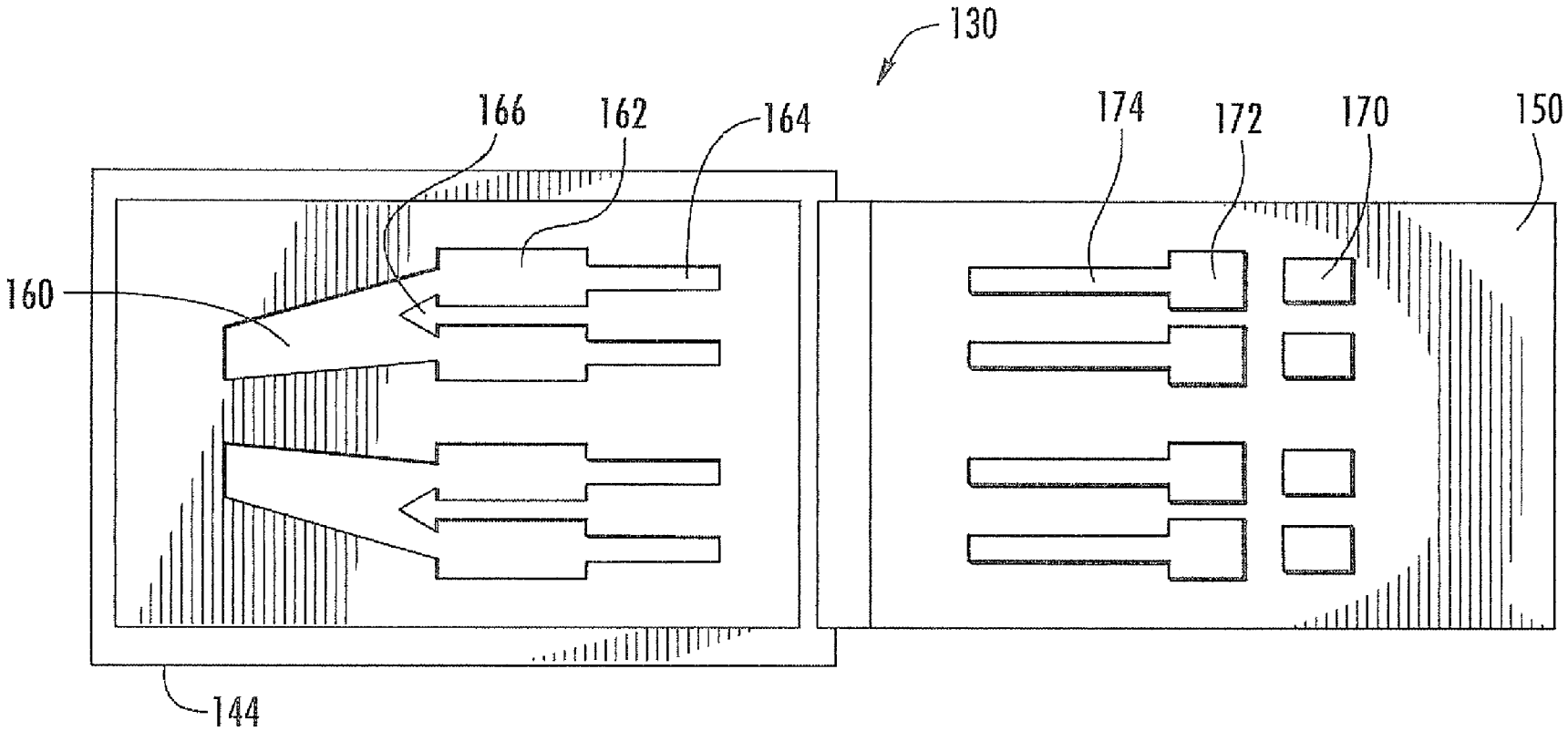
FIG. 10 is a plan view of the board edge termination assembly of FIG. 7 before the pivotable cap is pivoted into place.

FIG. 10 is a plan view of the board edge termination assembly 130 of FIG. 7 before the pivotable cap 150 is pivoted into place.

In certain embodiments of the present invention, the board edge termination assembly 130 may be used to facilitate using communications jacks that have generally horizontally oriented printed circuit boards in communications patch panels. In particular, as is well known to those of skill in the art, a patch panel refers to an assembly that includes a plurality of communications jacks (typically 24 or 48, although other numbers of jacks may be included) that are aligned in rows. Typically, a plurality of patch panels will be mounted on one or more equipment racks in a network computer room of, for example, an office building. In order to allow a large number of communications jacks to be mounted in an accessible manner in a small space, typically each patch panel has a vertical height of 1.75 inches, and a large number of patch panels (e.g., 10 or 12) may be stacked vertically on an equipment rack. Due to this close vertical spacing, it may be difficult to use communications jacks that that have horizontally mounted printed circuit boards (i.e., a jack that has a printed circuit board that lies in a plane parallel to the plane defined by the lower surface of the plug aperture), because the wire connection terminals on such horizontally oriented printed circuit boards will typically extend in a vertical direction. As a result, any patch panel mounted on the equipment rack above the patch panel of interest will generally block access to the wire connection terminals of the communications jacks on the lower patch panel. For this reason, communications jacks that are used in patch panels typically have a vertically oriented printed circuit board. On such vertically oriented printed circuit boards, the wire connection terminals typically extend horizontally from the rear surface of the printed circuit board, and thus other patch panels on the equipment rack do not block access to these wire connection terminals.

Using board edge termination assemblies according to embodiments of the present invention, however, makes it both possible and convenient to use communications jacks having horizontally-oriented printed circuit boards in patch panel applications. In particular, the board edge termination assembly 130 may have a sufficiently low profile that it may be inserted onto the end of the printed circuit board of a patch panel communications jack without immediately adjacent patch panels on the equipment rack making it difficult to terminate communications cables to the communications jacks.

Figure 2:
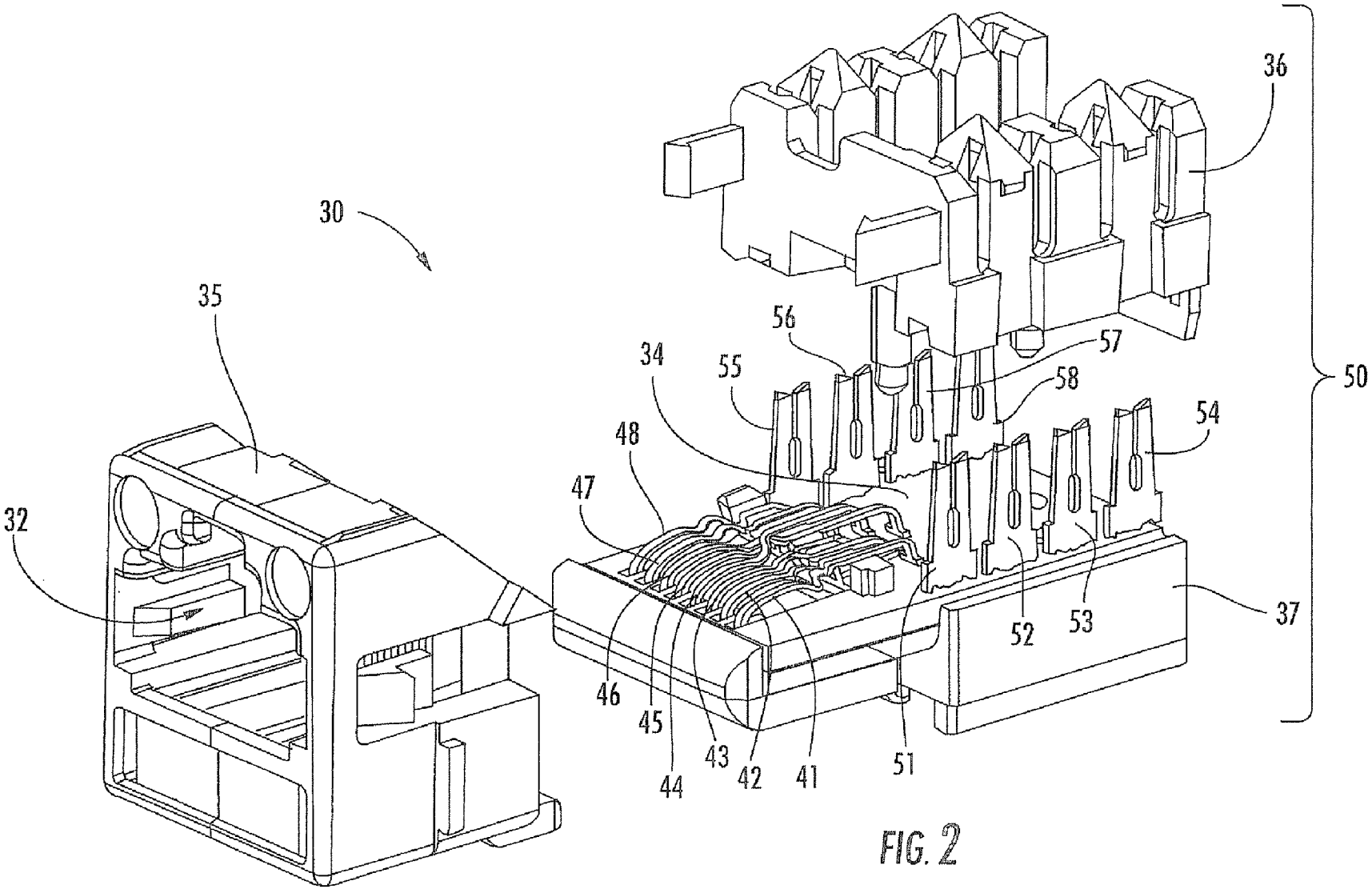
FIG. 2 is an exploded perspective view of the communications jack of FIG. 1.

The use of board edge termination assembly 130 or other board edge terminations according to embodiments of the present invention may also make it easier for installers to change the communications cable that is terminated to a particular communications jack. In particular, as described above with respect to FIGS. 2-3, with most conventional communications jacks, the communications cable is terminated to the back end thereof by individually seating each conductor of the communications cable into a respective insulation displacement contact. Accordingly, in situations in which a second communications cable must later be attached to such a communications jack in place of an already terminated first communications cable, each conductor of the first communications cable must be individually removed from its respective IDC, and then each conductor of the second communications cable must be individually inserted into its respective IDC. Moreover, before the first communications cable can be attached to a second communications jack, it may be necessary to remove a small portion of the jacket at the end of the cable and to clip off the ends of each individual conductor so that an insulated portion of each conductor may be inserted into its respective IDC on the second jack. The above operations may require a significant amount of time, particularly in situations where the terminations on a large number of communications jacks must be changed.

In contrast, with the of board edge termination assemblies according to embodiments of the present invention, a first cable may be readily removed from a communications jack simply by pulling the board edge termination assembly off of the end of the jack and replacing it with a board edge termination assembly that is installed on another communications cable (it may be necessary to depress a latch or some other mechanism in removing the board edge termination that is attached to the first cable if a snap latch or other connection mechanism is included on the board edge termination). This capability is available because the board edge termination assemblies according to embodiments of the present invention may be "releasably attachable" to the back end of a communications jack such that they can be readily removed after they have been attached and connected to a different communications jack. Thus, the board edge termination assemblies according to embodiments of the present invention may, in certain situations, simplify the process of changing the communications cable that is terminated to a communications jack.

The board edge termination assemblies according to embodiments of the present invention may also include features that are designed to reduce the amount of crosstalk added in the back end of communications jack 100. For example, as shown in FIG. 9, the contact members 181-188 may be arranged so that contact members of the same differential pairs 71-74 are placed next to each other. Likewise, the contact members 181-188 of different differential pairs 71-74 may be spaced apart from each other, in both the horizontal and vertical directions. For example, as shown in FIG. 9, contact members 181-182 (the first differential pair) are spaced directly next to each other, but are spaced farther apart horizontally from contact members 183-186 (the second differential pair). The same is true for contact members 184-185 (the third differential pair) and contact members 187-188 (the fourth differential pair). Likewise, along the vertical axis each of the four differential pairs are offset from each other in order to minimize unwanted coupling between differential pairs located on the opposite sides of printed circuit board 120.

In addition, the wire termination portion **181*b*-188*b* of each contact member 181-188 may comprise a low-profile IDC that has decreased surface area compared to conventional IDCs that are typically used in communications jacks. Such low-profile IDCs may be used in the board edge termination assembly 130 because the conductor receiving slot wraps around the IDC's 90 degree bend in order to get equivalent deflection range of a 0.240" high IDC as can be seen, for example, with respect to contacts 184, 185, 187 and 188 in FIG. 4**. In certain embodiments of the present invention, the low-profile IDCs may have a height of between about 0.07" to about 0.13" as compared to a typical height of about 0.24" for an exemplary conventional IDC. By decreasing the surface area of the raised portion of each IDC it may be possible to further reduce crosstalk between the various differential pairs.

Likewise, the twist terminators 166 may provide an easy and convenient method by which an installer can determine where each differential pair should transition from a twisted to an untwisted configuration. As the transition point may effect the coupling between differential pairs, and hence the overall amount of crosstalk, by better controlling the location where each differential pair transitions from a twisted to an untwisted state the expected amount of crosstalk that the communications jack will induce in operation may be more precisely known, and hence the jack can be better designed to approximately cancel that crosstalk. Likewise, by allowing the differential pairs to remain twisted right up to the contact members 181-188, the overall amount of crosstalk induced in the board edge termination assembly 130 may be reduced.

Moreover, the arrangement of contact members 181-188 depicted in FIG. 9 may not only facilitate reducing crosstalk between the four differential pairs, it may also facilitate reducing "alien" near end crosstalk ("alien NEXT"), which is crosstalk between the conductors of one cable with the conductors of a different communications cable. This arrangement may be used to maximize separation between a pair and its nearest neighbor in an adjacent connector, since it places it at the opposite face of the printed circuit board, thus reducing alien crosstalk.

Figures 12, 13, 14:
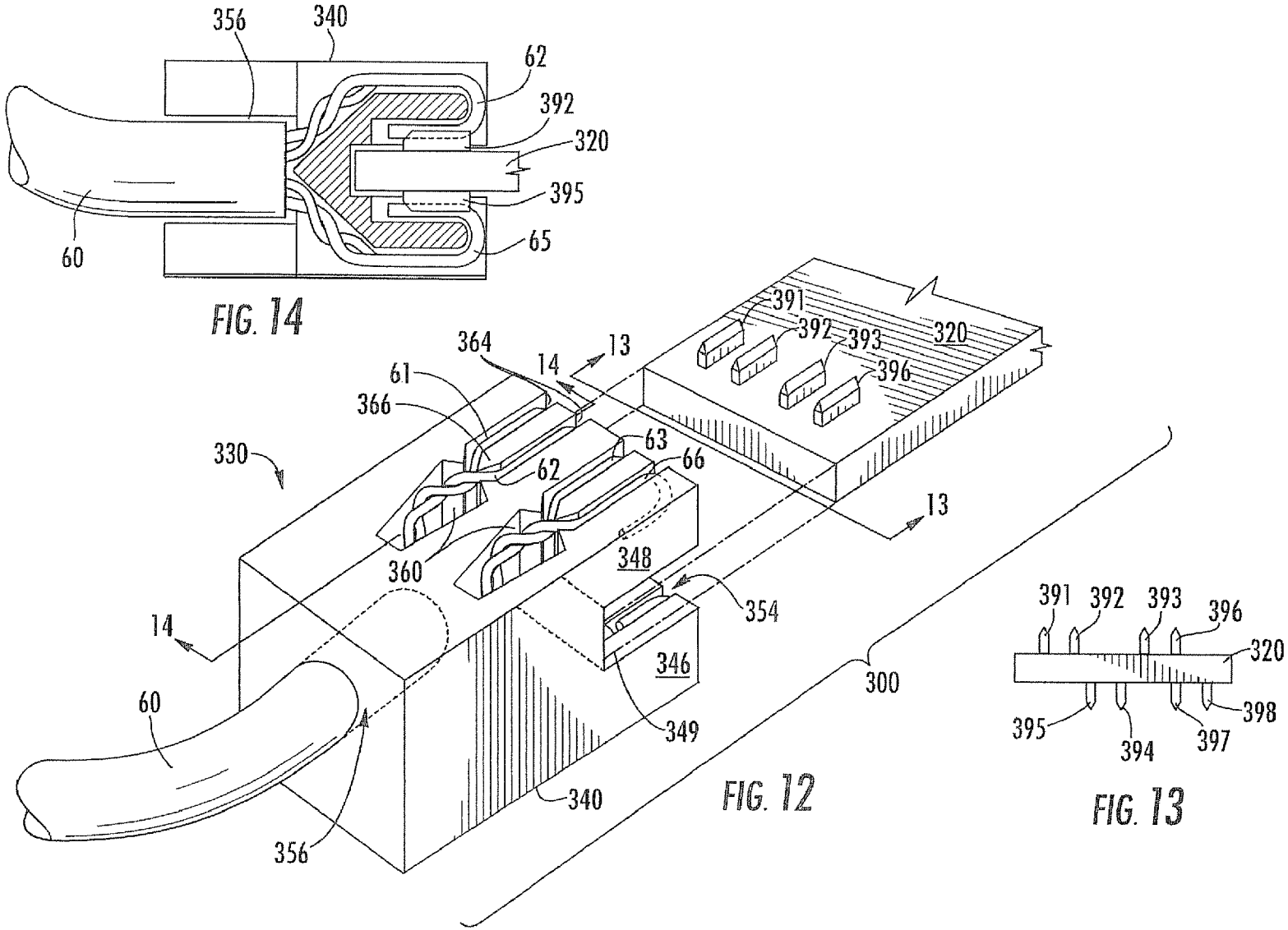
FIG. 12 is a perspective view of a communications jack that includes a board edge termination assembly according to further embodiments of the present invention.
FIG. 13 is a cross-sectional view of a printed circuit board of the communications jack of FIG. 12 taken along the line 13-13 of FIG. 12.
FIG. 14 is a cross-sectional view of the board edge termination assembly of FIG. 12 taken along the line 14-14 of FIG. 12.

FIG. 12 is a perspective view of a communications jack 300 that includes a board edge termination assembly 330 according to further embodiments of the present invention. FIG. 13 is cross-sectional view of a printed circuit board 320 of communications jack 300 taken along the line 13-13 of FIG. 12. FIG. 14 is cross-sectional view of the board edge termination assembly 330 taken along the line 14-14 of FIG. 12. In FIG. 12, only the board edge termination assembly 330 and the rear portion of the printed circuit board 320 of the communication jack are depicted. It will be appreciated that the remainder of the communication jack 300 may have a variety of different configurations.

As shown in FIG. 12, a plurality of output contacts 391-398 are mounted on the printed circuit board 320 (only output contacts 391-393 and 396 are visible in FIG. 12; output contacts 394-395 and 397-398 are provided on the bottom side of the printed circuit board 320 as shown in FIG. 13). In the embodiment of FIG. 12, the output contacts 391-398 comprise contact blades that are pressed into the printed circuit board 320 (four contacts on each side of the board) adjacent the rear edge of the printed circuit board 320. Each output contact 391-398 may comprise a conductive element (e.g., a steel or copper blade or a gold plated metal strip) that may have a small profile and may include a sharp edge that cuts through the insulation of a respective one of the conductors 61-68 along the axis of the conductor, thereby establishing a sound electrical connection between each output contact 391-398 and a respective one of the conductors 61-68. Each output contact 391-398 may be connected to a respective one of a plurality of conductive paths (not shown) on the printed circuit board 320 which, in turn, are connected to respective input contacts (not shown) of the communications jack 300. Thus, the board edge termination assembly 330 may be used to electrically connect the each of the conductors 61-68 of the cable 60 to a respective input contact of the communications jack 300. It will be appreciated that FIG. 12 is only an illustration of the concept. Thus, for example, plastic protection would likely be included around the sharp edges of the contacts 391-398 (not shown). Likewise, alignment flanges may be provided to ensure that the printed circuit board 320 properly aligns with the board termination assembly 330.

The communications jack 300 further includes a board edge termination assembly 330. As shown in FIG. 12, the board edge termination assembly 330 includes a body 340 and first and second spaced apart shelves 346, 348. The shelves 346, 348 define an opening 349 therebetween which receives the rear edge of printed circuit board 320. The portion of the body 340 opposite the shelves 346, 348 includes an aperture 356 that receives a communications cable 60. The board edge termination assembly 330 may be formed of, for example, polycarbonate, ABS, ABS/polycarbonate blend or like dielectric molded materials.

As shown in FIG. 12, the top surface of the body 340 includes two recessed areas 360. The bottom surface of the body 340 includes two additional recessed areas 360 (not visible in FIG. 12). One end of each recessed area 360 is connected by a passage such as a channel or an opening to the aperture 356 which receives the communication cable 60. The communications cable 60 includes eight insulated conductors 61-68 which are arranged as four differential pairs 71-74. The individual conductors that comprise each differential pair 71-74 (i.e., conductors 61/62, 63/66, 64/65 and 67/68) are twisted about each other, and all four differential pairs 71-74 are twisted about each other in a "core twist." The end of each of the conductors 61-68 is passed through a respective one of the above-mentioned passages that connect aperture 356 and each recessed area 360 into the rear portion 361 of each recessed area 360. This is more clearly illustrated in FIG. 14.

Each recessed area 360 further includes a twist terminator 366 that may be used to consistently set the location where the differential pairs 71-74 received within the respective recessed areas 360 switch from a twisted to an untwisted configuration. Here, the twist terminator 366 includes a pointed, or knife-like, ridge that may help a technician to separate the individual conductors 61-68 within each differential pair 71-74. Each recessed area 360 further includes a pair of channels 364 that are separated by a vertical wall. As shown in FIG. 12, each differential pair 71-74 is routed into a respective one of the recesses 360. In the back portion of each recess 360 the differential pair 71-74 may remain twisted. A respective one of the twist terminators 366 is then used to separate the individual conductors 61-68 within each differential pair 71-74, and each separated conductor 61-68 is routed into a respective one of the channels 364. As shown best in FIG. 14, each channel 364 extends toward the forward edge of its respective shelf 346, 348 and then bends around the front edge of the shelf into the opening 349. A technician may insert the end of each conductor 61-68 into its respective channel 364 so that each conductor 61-68 likewise bends around the front edge of the shelf into the opening 349. When the rear edge of printed circuit board 320 is inserted into the opening 349 in board edge termination assembly 330, each output contact is aligned with a respective one of the conductors 61-68 that are seated in their respective slots 364. The sharp edge on each output contact cuts the insulation surrounding its respective conductor to make sound mechanical and electrical contact with the conductor.

Figure 15:
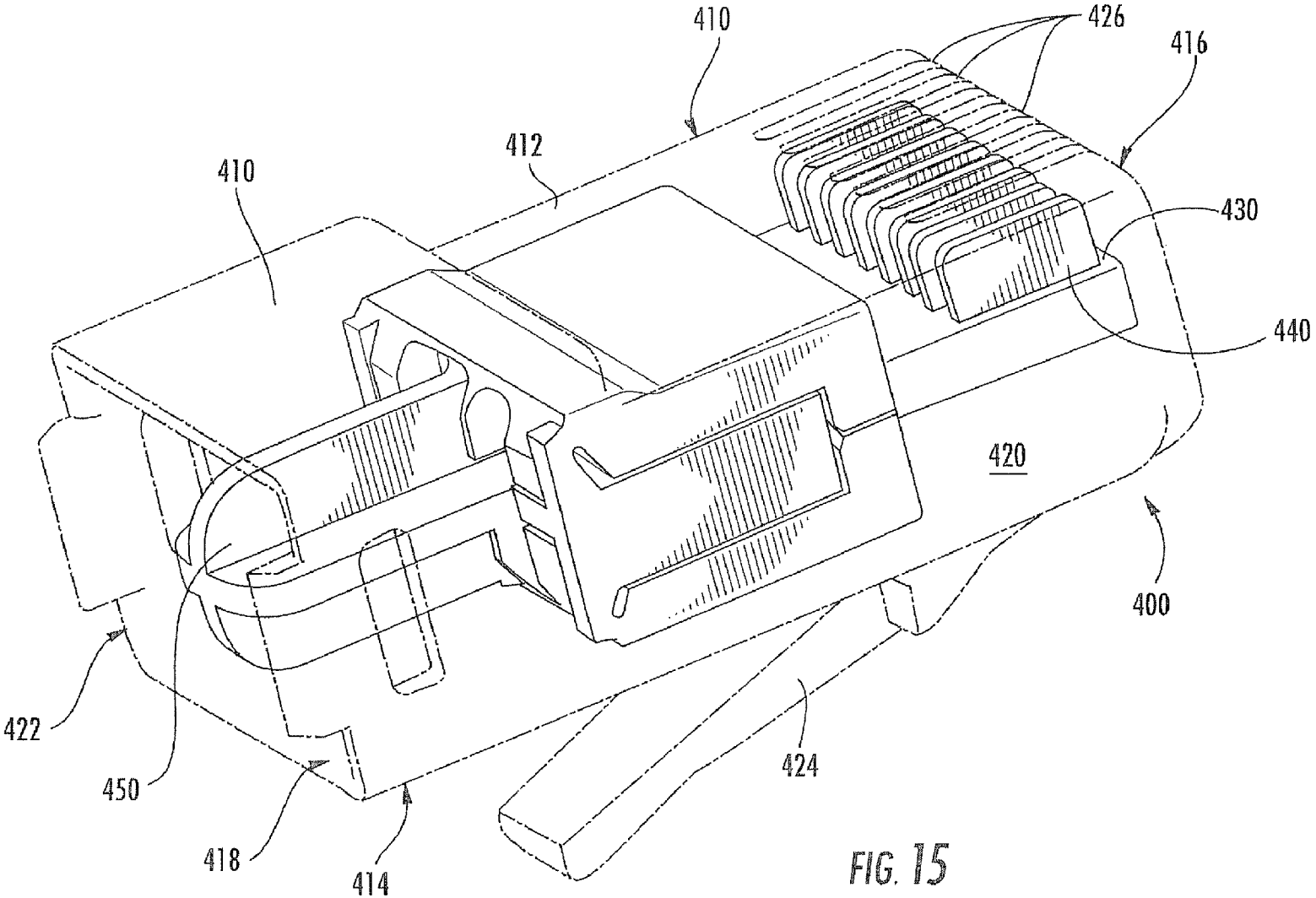
FIG. 15 is a perspective view of a communications plug that includes a board edge termination assembly according to further embodiments of the present invention.
Figure 16:
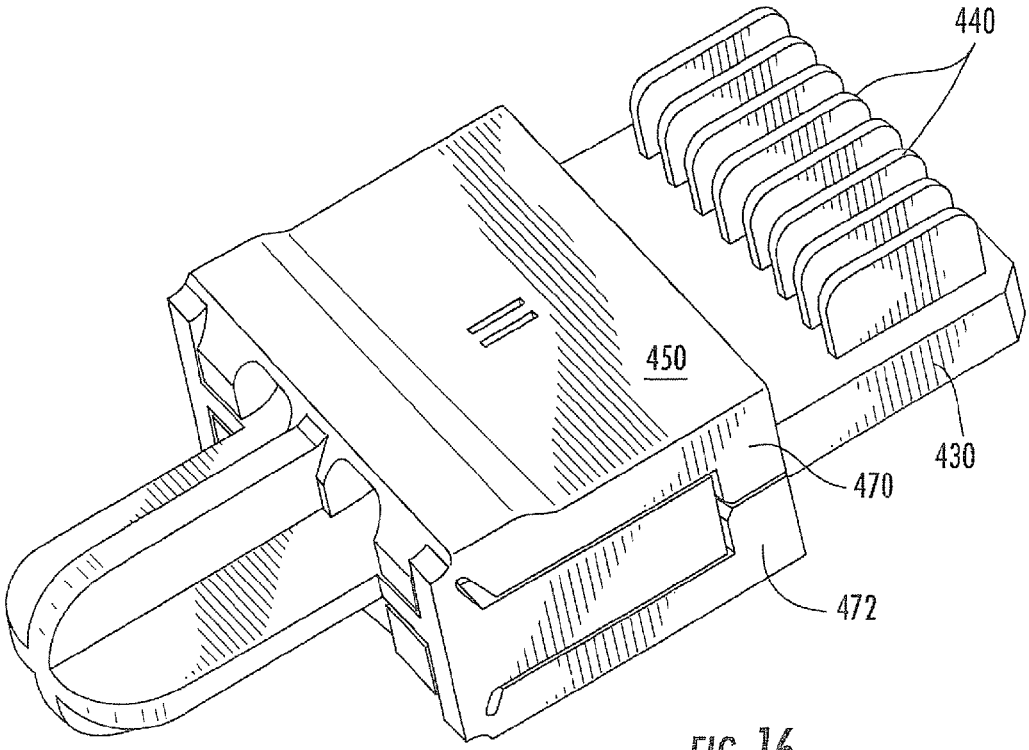
FIG. 16 is a perspective view of the board edge termination assembly and printed circuit board of the communications plug of FIG. 15.
Figure 17:
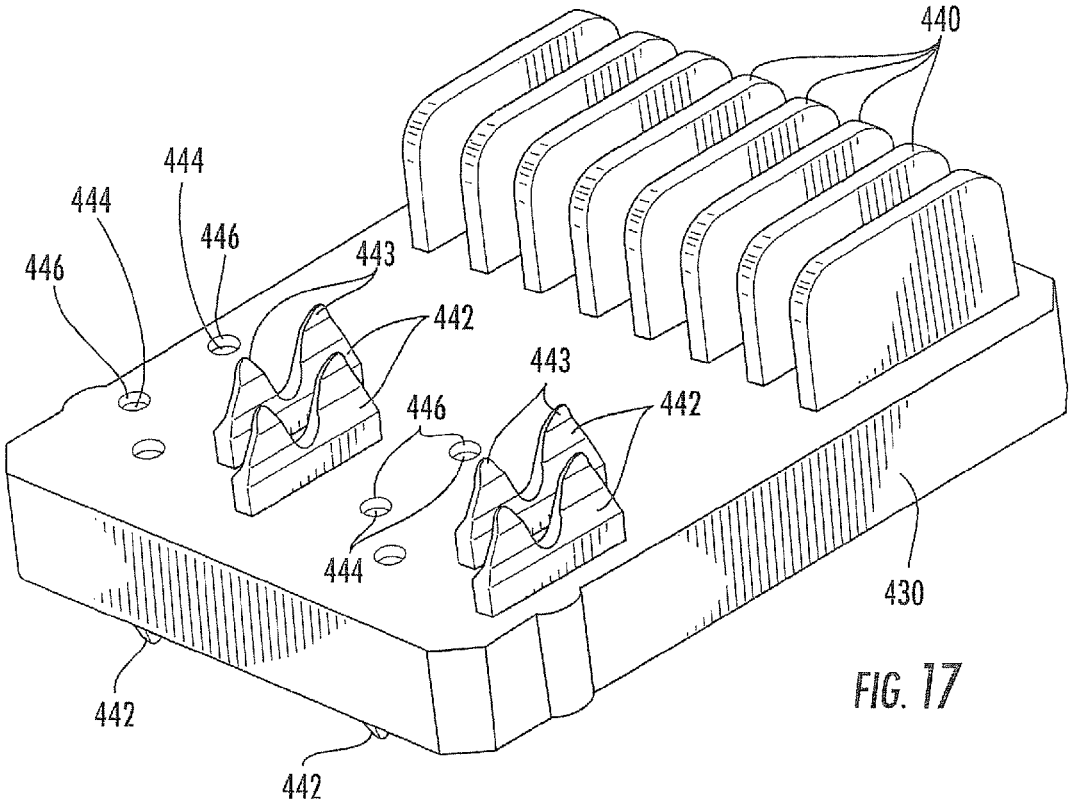
FIG. 17 is an enlarged perspective view of the printed circuit board of the communications plug of FIG. 15.
Figure 18:
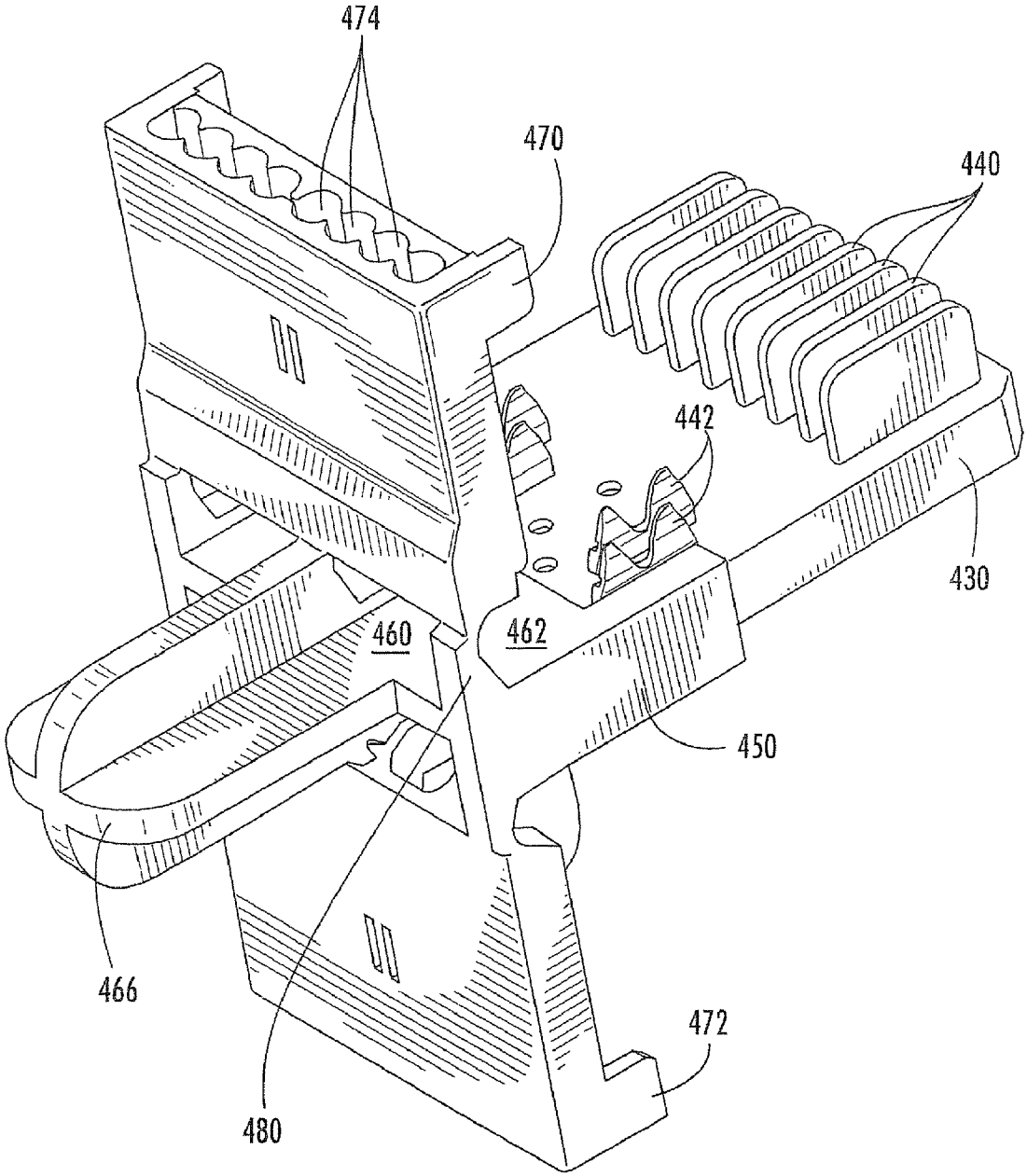
FIG. 18 is a perspective view of the board edge termination assembly and printed circuit board of the communications plug of FIG. 15 with the board edge termination assembly in an open position.
Figure 19:
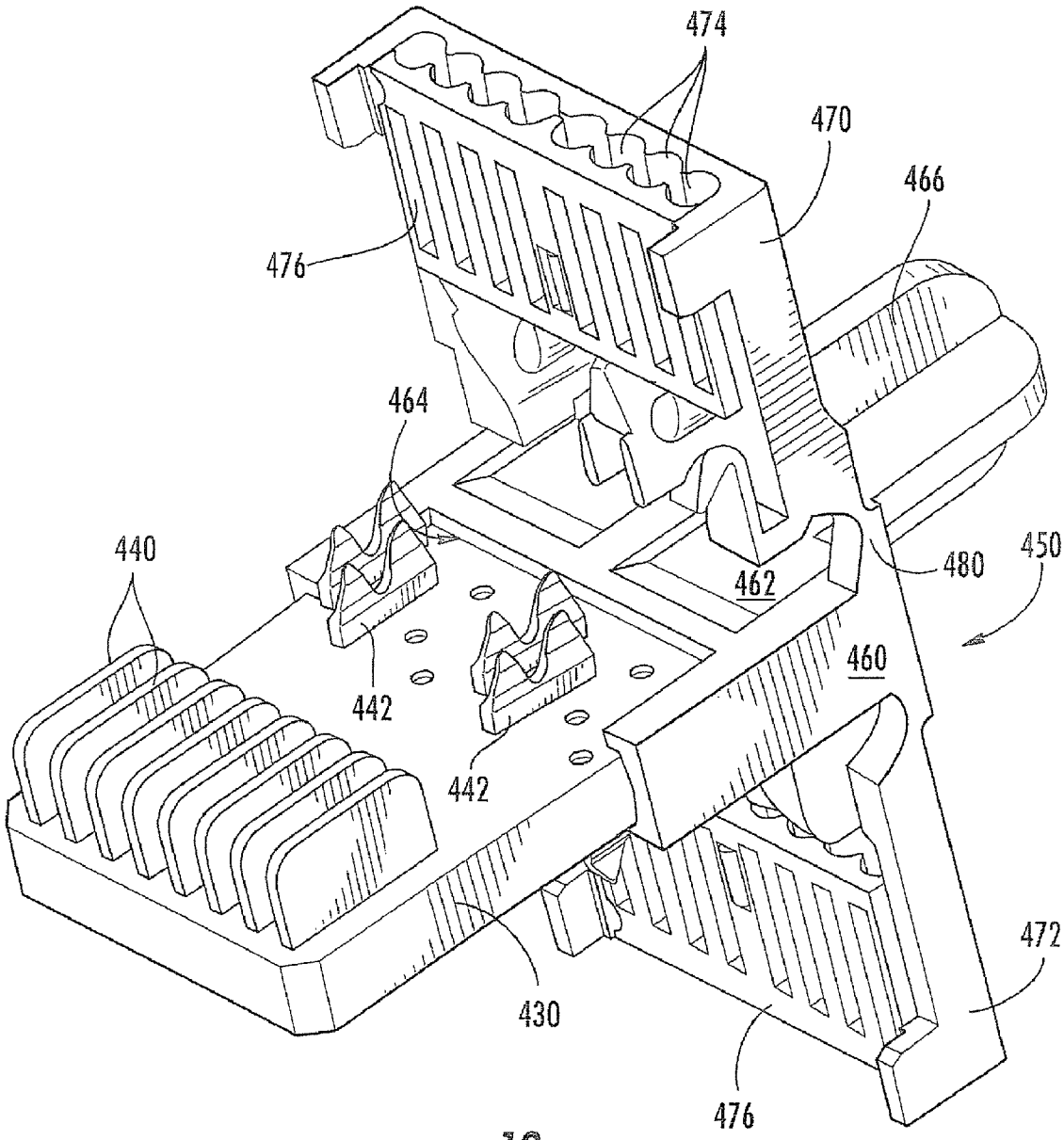
FIG. 19 is another perspective view of the board edge termination assembly and printed circuit board of the communications plug of FIG. 15 with the board edge termination assembly in an open position.
Figure 20:
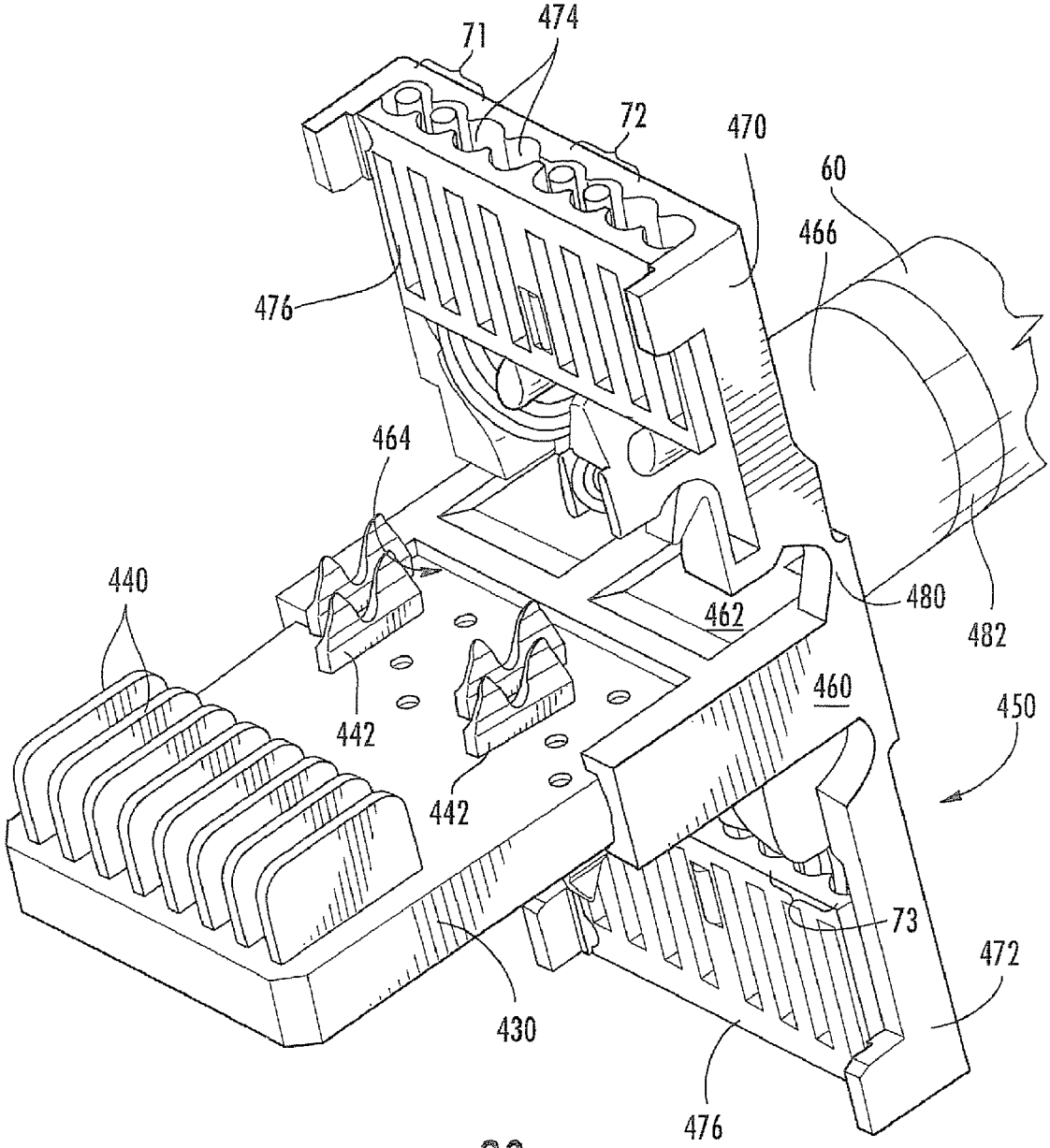
FIG. 20 is a perspective view of the board edge termination assembly and printed circuit board of the communications plug of FIG. 15 with a communications cable attached to the board edge termination assembly.

According to further embodiments of the present invention, communications plugs may be provided that include board edge termination assemblies. FIGS. 15-20 depict one such communications plug 400 according to some embodiments of the present invention. In particular, FIG. 15 is a perspective view of the communications plug 400. FIG. 16 is a perspective view of the board edge termination assembly 450 and the printed circuit board 430 of the communications plug 400. FIG. 17 is a perspective view of the printed circuit board 430. FIGS. 18 and 19 are perspective views of the board edge termination assembly 450 in an open position. Finally, FIG. 20 is a perspective view of the board edge termination assembly 450 in an open position with a communication cable attached thereto.

As shown in FIG. 15, the communications plug 400 includes a housing 410 having a top face 412, a bottom face 414, a front face 416, a rear face 418 and a pair of side faces 420. The rear face 418 includes a generally rectangular opening 422. A plug latch 424 extends from the bottom face 418. The top and front faces 412, 416 include a plurality of longitudinally extending slots 426 that expose a plurality of plug blades 440. A communications cable (not shown in FIG. 15) is received through the rectangular opening 422. The communications cable may include a strain relief mechanism (not shown in FIG. 15) that is also received within the interior of the housing 410. A rear cap (not shown in FIG. 15) that includes a cable aperture locks into place over the rear face 418 of housing 410 after the communications cable has been inserted into the rear face 418 of the housing 410. As is also shown in FIG. 15, the communications plug 400 further includes a printed circuit board 430 and a board edge termination assembly insert 450, each of which are disposed within the housing 410. Any conventional housing 410 may be used that is configured to hold the printed circuit board 430 and the board edge termination assembly 450, and hence the housing 410 is not described in further detail herein. It will be appreciated that the housing 410 may comprise a one-piece housing or a multi-piece housing.

FIG. 16 is an enlarged perspective view of the printed circuit board 430 and the board edge termination assembly insert 450. The printed circuit board 430 may comprise, for example, a conventional printed circuit board, a specialized printed circuit board (e.g., a flexible printed circuit board) or any other type of wiring board. In the embodiment of the present invention depicted in FIGS. 15-20, the printed circuit board 430 comprises a multi-layer printed circuit board that is substantially planar. As shown in FIG. 16, a plurality of plug contacts 440 (which conventionally are referred to as blades) are mounted in the printed circuit board 430. The plug blades 440 are mounted at the forward edge of the printed circuit board 430 so that the blades 440 can be accessed through the slots 426 that are provided on the top and front faces of the housing 410 (see FIG. 15). The plug blades 440 may comprise any conventional or non-conventional plug blades that are configured to make mechanical and electrical contact with respective contacts, such as, for example, spring jackwire contacts, of a mating communications jack. In the depicted embodiment, each plug blade 440 comprises a thin rectangular member that is electrically connected to at least one conductive trace on the printed circuit board 430. As another example, in other embodiments, each plug blade may comprise a thin, generally rectangular contact pad that is provided on the top surface of the printed circuit board 430 and that extends onto the front edge of the printed circuit board 430 so that the contact pads are substantially transversely aligned in side-by-side relationship and each contact pad is exposed through a respective one of the slots 426.

FIG. 17 is a perspective view of the printed circuit board 430 before the printed circuit board 430 is inserted within the board edge termination assembly insert 450. As can be seen in FIG. 17, a plurality of output contacts 442 are mounted at the rear of printed circuit board 430. In the particular embodiment of FIGS. 15-20, a total of eight plug blades 440 and a total of eight output contacts 442 are mounted on the printed circuit board 430 (only four of the output contacts 442 are fully visible in FIG. 17), All eight plug blades 440 are mounted on the top surface of printed circuit board 430, whereas four of the output contacts 442 are mounted on the top surface of printed circuit board 430 while the remaining four output contacts 442 (not shown) are mounted on the bottom surface of printed circuit board 430. In this embodiment, the output contacts 442 are implemented as insulation piercing contacts that include a pair of sharpened triangular cutting surfaces 443. These insulation piercing contacts 442 may be longitudinally aligned next to an insulated conductor that is mounted in the board edge termination assembly 450, as will be discussed in further detail below. When the insulated conductor is pressed against its respective insulation piercing contact 442, the sharpened triangular cutting surfaces 443 will pierce the insulation of the insulated conductor to make physical and electrical contact with the conductor. Each insulation piercing contact 442 includes a pair of base posts 444 that are mounted in, for example, metal plated apertures in the printed circuit board 430. At least one of the base posts 444 of each insulation piercing output contact 442 may be electrically connected to a conductive path (not shown in FIGS. 15-20) on the printed circuit board 430. These conductive paths may be used to electrically connect each of the output contacts 442 to a respective one of the plug blades 440. Thus, the output contacts 442 and the conductive paths electrically connect each plug blade 440 to a respective conductor of a communications cable that connects to the back end of the communications plug 400.

In the particular embodiment of the present invention depicted in FIGS. 15-20, the output contacts 442 are arranged in pairs. The output contacts of each pair are offset slightly, and the pairs are substantially transversely aligned. As noted above, four of the output contacts 442 are provided on the top surface of the printed circuit board 430, while the remaining four output contacts are provided on the bottom surface of printed circuit board 430. This arrangement of output contacts 442 may facilitate reducing crosstalk between the four differential pairs as well as reducing alien NEXT. It will be appreciated that the output contacts need not be insulation piercing contacts 442. For example, in other embodiments, the output contacts could comprise conventional insulation displacement contacts (IDCs).

As noted above, a conductive path extends between each plug blade 440 and a respective one of the output contacts 442. Each conductive path may comprise, for example, one or more conductive traces that are provided on one or more layers of the printed circuit board 430. When a conductive path includes conductive traces that are on multiple layers of the printed circuit board 430, metal-plated or metal-filled through holes (or other layer-transferring structures known to those skilled in this art) may be provided that provide an electrical connection between the conductive traces on different layers of the printed circuit board 430.

Turning again to FIG. 16 as well as FIGS. 18-19, the board edge termination assembly 450 will now be described in greater detail. As discussed above, a board edge termination assembly is an assembly that mates with a printed circuit board of a communications connector to electrically connect the conductors of a communications cable to the printed circuit board. The board edge termination assembly 450 may be formed of, for example, polycarbonate, ABS, ABS/polycarbonate blend or like dielectric molded materials.

As shown best in FIGS. 18 and 19, the board edge termination assembly 450 includes a body 460 that has a central portion 462 that includes an aperture 464 that receives the rear end of the printed circuit board 430. A separator 466 extends rearwardly from the central portion of the body 460. This separator 466 may be received within the jacket of a communications cable (not shown in FIGS. 15-20) that is attached to the communications plug 400. As discussed above with respect to FIG. 3, the communications cable may include eight insulated conductors which are arranged as four twisted differential pairs. The separator 466 may be used to separate the four twisted differential pairs of conductors contained within the communications cable, as is known to those of skill in the art.

As is further shown in FIGS. 16 and 18-19, a first pivotable cap 470 extends upwardly from the central portion 462 of the body 460, and a second pivotable cap 472 extends downwardly from the central portion 462. As shown best in FIG. 19, each pivotable cap 470, 472 includes a plurality of wire passages 474. In the particular embodiment of FIGS. 15-20, each pivotable cap includes eight wire passages 474. The wire passages 474 are formed in the interior surface of each pivotable cap 470, 472. A separate wire retainer piece 476 completes each wire passage 474. In regular use, the end portions of the conductors of two of the differential pairs of a communications cable that is attached to communications plug 400 are untwisted and placed within four of the eight wire passages 474 in the pivotable cap 470 (i.e., the four wire passages 474 that are aligned with the insulation piercing contacts 442 that are provided on the top surface of printed circuit board 430), while the end portions of the conductors of the remaining two differential pairs of the communications cable are untwisted and placed within four of the eight wire passages 474 in the pivotable cap 472 (i.e., the four wire passages 474 that are aligned with the insulation piercing contacts 442 that are provided on the bottom surface of printed circuit board 430). It will be appreciated, that fewer than eight wire passages 474 may be provided on each pivotable cap 470, 472 in other embodiments.

Once the conductors of the communication cable are received within their respective wire passages 474, the pivotable caps 470, 472 may be pivoted from their open position (which is shown in FIGS. 18-19) to their closed position (which is shown in FIGS. 15-16). This is possible because each pivotable cap 470, 472 is a hinged cap that pivots about hinges 480 (see FIG. 19). As the pivotable caps 470, 472 are moved to their closed position, each conductor of the communications cable is brought into contact with a respective one of the insulation piercing contacts 442. When the pivotable caps 470, 472 have been moved into a fully closed position, each insulation piercing contact 442 will have pierced the insulation on its respective conductor, thereby making physical and electrical contact with the conductor. In this manner, each conductor of the communication cable is electrically connected to a respective one of the plug blades 440 via an insulation piercing contact 442 and a conductive path on the printed circuit board 430.

FIG. 20 is a perspective view of the board edge termination assembly 450 with the communications cable 60 terminated thereon (except for the closing of the pivotable caps 470, 472). As shown in FIG. 20, one end of the communications cable 60 is inserted over the separator 466. The separator 466 is used to divide the four differential pairs 71-74 of the cable into different quadrants. Differential pairs 71 and 72 are routed towards the pivotable cap 470, where the conductors thereof are untwisted and placed within respective ones of the wire passages 474. Likewise, the remaining two differential pairs 73 and 74 are routed towards the pivotable cap 472 (only pair 73 is visible in FIG. 20), where the conductors thereof are also untwisted and placed within respective ones of the wire passages 474. As is also shown in FIG. 20, a strain relief mechanism 482 may be placed on the end of the communications cable 60. This strain relief mechanism 482 engages the jacketed cable 60 and firmly holds the jacketed cable 60 against the separator 466. In the depicted embodiment, the strain relief mechanism 482 comprises a compressible wedge collar that surrounds the jacketed cable 60 and pinches against the jacketed cable 60. This cable strain relief mechanism 482 may be locked into place against the jacket in order to provide strain relief in the event that communications cable 60 is pulled after the board edge termination assembly 450 is attached thereto. By having the cable strain relief mechanism 482 contact a jacketed portion of the communications cable 60, it may be possible to better maintain each differential pair in its proper position within the cable, which may help reduce the overall crosstalk levels.

Turning again to FIG. 16, the board edge termination assembly 450 is shown after the pivotable caps have been snapped into their closed positions. The communications cable 60 is not shown in FIG. 16 to better show the features of the board edge termination assembly 450. While not shown in FIG. 16, releasable snap clips, latches or other connection mechanisms may be provided on body 460 and/or on pivotable caps 470, 472 so that pivotable caps 470, 472 are held securely in place once pivoted into their closed positions. In some embodiments of the present invention, the board edge termination assembly 450 may be configured or keyed to a feature on printed circuit board 430 (e.g., a slot) such that it will only fit over the rear edge of printed circuit board 430 in one orientation so that an installer may not mistakenly install board edge termination assembly 450 onto printed circuit board 430 upside down. Snap clips or other latching or connecting mechanisms (not shown in FIG. 16) may also be provided that securely connect the printed circuit board 430 to the board edge termination assembly 450.

Figure 21:
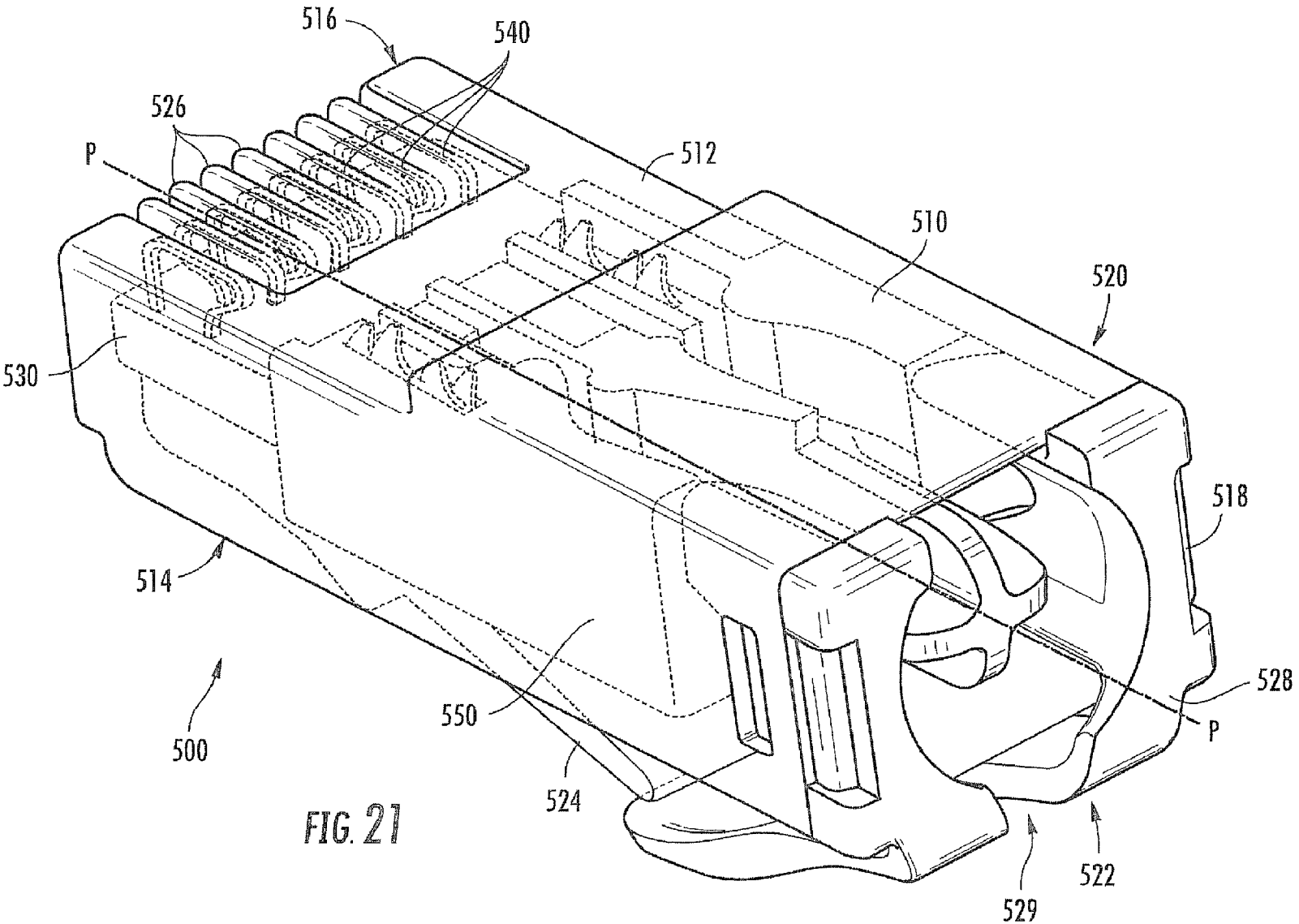
FIG. 21 is a perspective view of a communications plug that includes a board edge termination assembly according to still further embodiments of the present invention.
Figure 22:
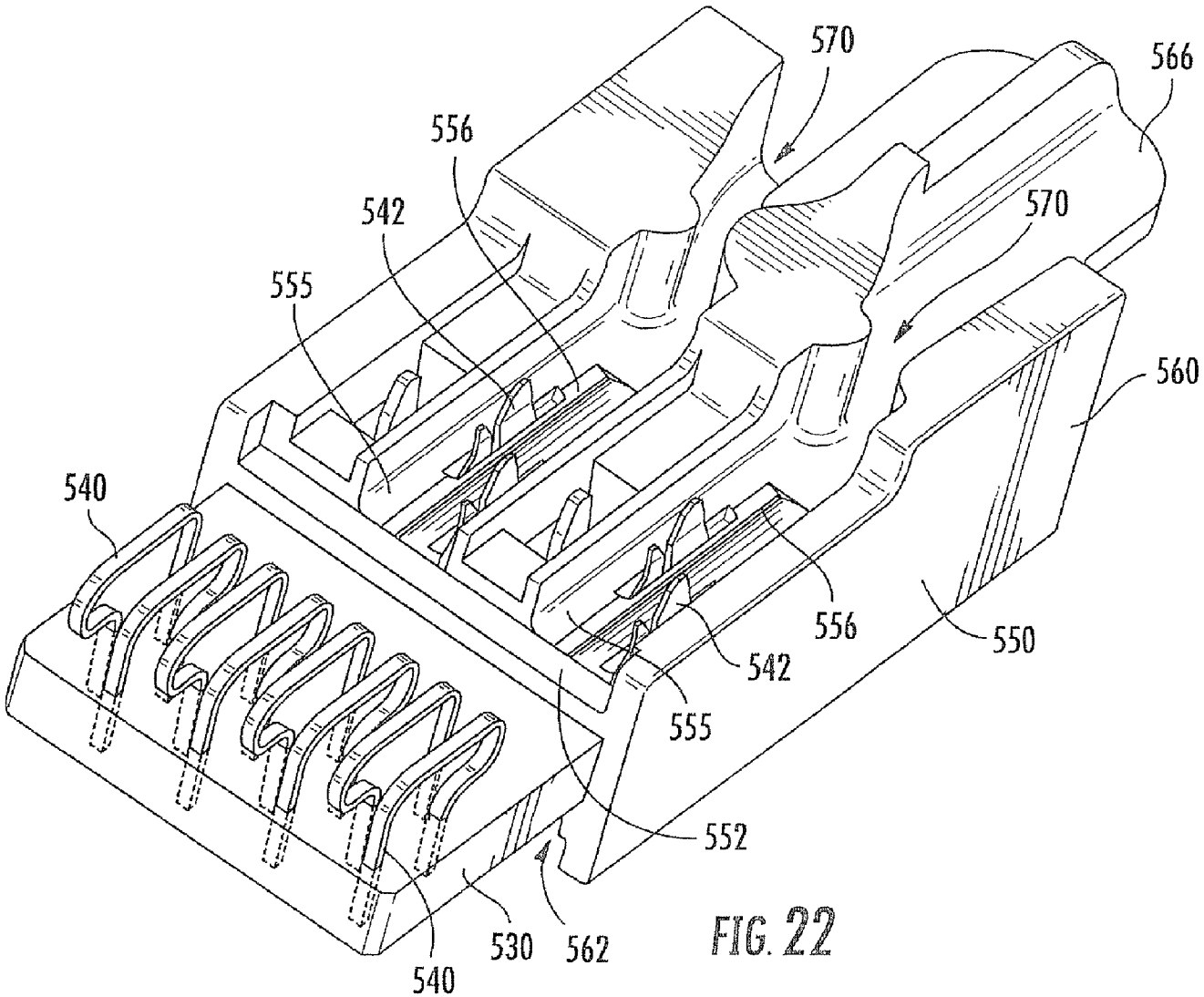
FIG. 22 is a top perspective view of the board edge termination assembly and printed circuit board of the communications plug of FIG. 21.
Figure 23:
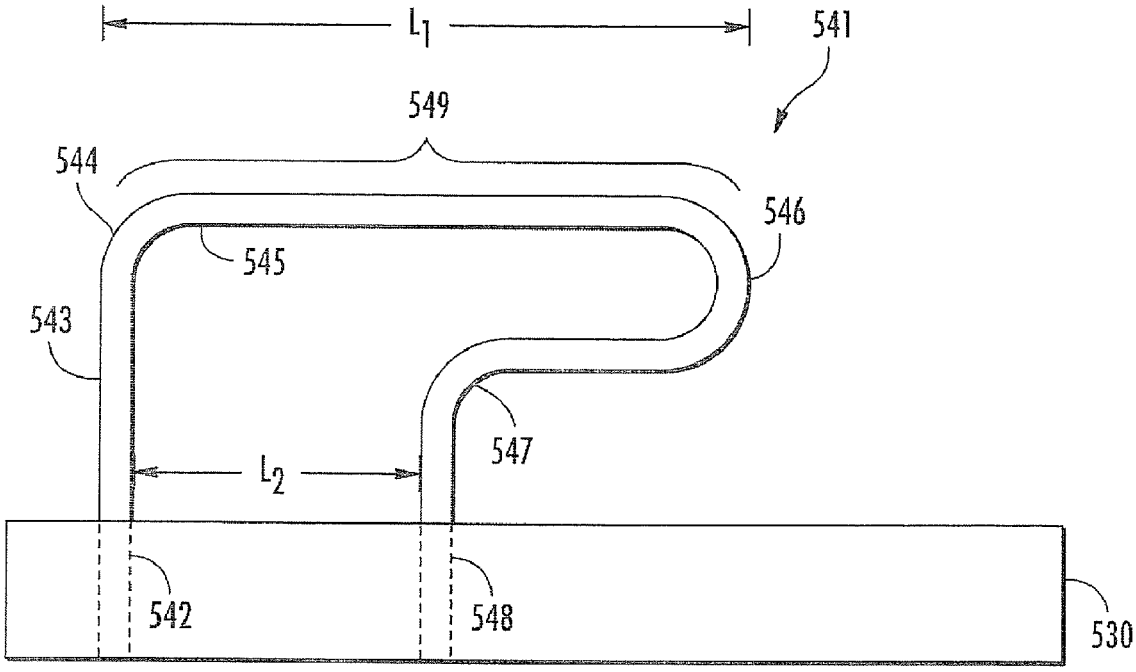
FIG. 23 is a side view of a plug blade of the communications plug of FIG. 21.
Figure 24:
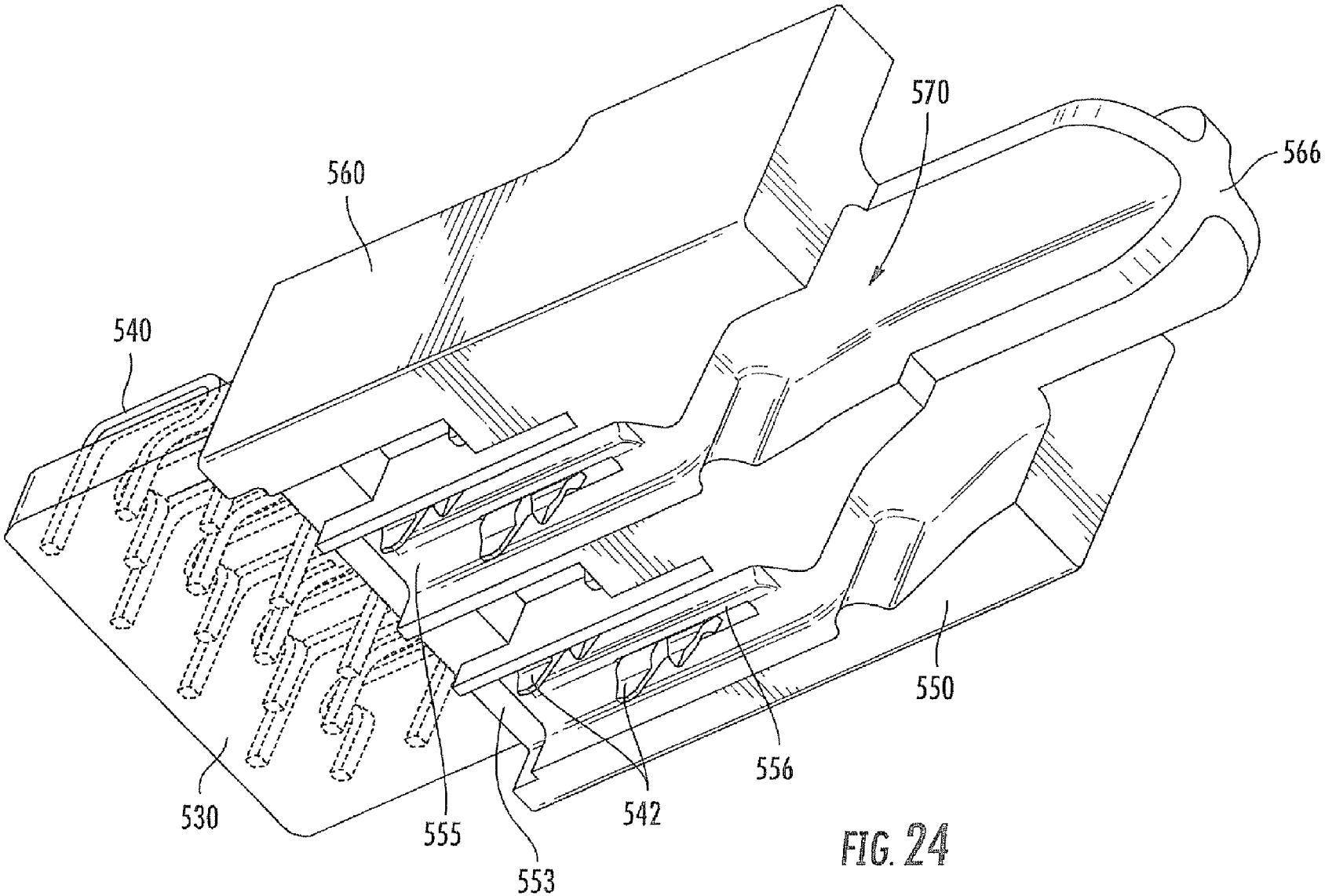
FIG. 24 is a bottom perspective view of the board edge termination assembly and printed circuit board of the communications plug of FIG. 21.

FIGS. 21-24 depict a communications plug 500 according to further embodiments of the present invention. In particular, FIG. 21 is a perspective view of the communications plug 500, while FIGS. 22 and 24 are perspective views of the board edge termination assembly 550 and printed circuit board 530 of the communications plug 500. FIG. 23 is a side view of a plug blade 540 of the plug 500. The communications plug may comprise an RJ-45 style modular communications plug. As known to those of skill in the art, such RJ-45 style plugs have (at least) eight plug blades and are designed to mate with an RJ-45 style modular jack.

As shown in FIG. 21, the communications plug 500 includes a housing 510 having a top face 512, a bottom face 514, a front face 516, a rear face 518 and a pair of side faces 520. The rear face 518 includes a generally rectangular opening. A plug latch 524 extends from the bottom face 514. The top and front faces 512, 516 include a plurality of longitudinally extending slots 526 that expose a plurality of plug blades 540. A communications cable (not shown in FIG. 21) is received through the rectangular opening in the rear face 518. The communications cable may include a strain relief mechanism (not shown in FIG. 21) that is also received within the interior of the housing 510. A rear cap 528 that includes a cable aperture 529 locks into place over the rear face 518 of housing 510 after the communications cable has been inserted into the rear face 518 of the housing 510.

As is shown in FIGS. 21-24, the communications plug 500 further includes a printed circuit board 530 and a board edge termination assembly insert 550, each of which are disposed within the housing 510. Any conventional housing 510 may be used that is configured to hold the printed circuit board 530 and the board edge termination assembly 550, and hence the housing 510 is not described in further detail herein. It will be appreciated that the housing 510 may comprise a one-piece housing instead of the multi-piece housing 510, 528 depicted in FIG. 21.

FIG. 22 is a front perspective view of the printed circuit board 530 and the board edge termination assembly insert 550. The printed circuit board 530 may comprise, for example, a conventional printed circuit board, a specialized printed circuit board (e.g., a flexible printed circuit board) or any other type of wiring board. In the embodiment of the present invention depicted in FIGS. 21-24, the printed circuit board 530 comprises a substantially planar multi-layer printed circuit board. As shown in FIG. 21, a plurality of plug blades 540 (eight blades in this embodiment) are mounted near the forward edge of the top of the printed circuit board 530 so that the blades 540 can be accessed through the slots 526 that are provided on the top and front faces of the housing 510. In this embodiment, the plug blades 540 are each formed using wires that are mounted in apertures in the printed circuit board 530. While one particular plug blade 540 is illustrated in FIGS. 21-24, it will be appreciated that any conventional or non-conventional plug blades that are configured to make mechanical and electrical contact with respective contacts, such as, for example, spring jackwire contacts, of a mating communications jack may be used. Thus, for example, in other embodiments, each plug blade may comprise a thin, generally rectangular contact pad or contact element that is provided on the top surface of the printed circuit board 530 and that extends onto the front edge of the printed circuit board 530 so that the contact pads/elements are substantially transversely aligned in side-by-side relationship and each contact pad is exposed through a respective one of the slots 526.

As shown in FIG. 22, each plug blade 540 may be implemented by mounting a wire 541 into spaced-apart apertures on the printed circuit board 530. In this manner, a "skeletal" plug blade 540 is formed that has a hollow central portion. As shown in FIG. 22, a total of eight plug blades 540 are provided that are arranged in a side-by-side relationship. As shown in FIG. 23, each wire 541 includes a first end 542 that is mounted in a first aperture in the printed circuit board 530, a generally vertical segment 543 that extends from the aperture in the printed circuit board that holds the first end 542, a first transition segment 544 which may be implemented as a generally ninety degree bend, a generally horizontal segment 545, a generally U-shaped projection segment 546 which extends from an end of the generally horizontal segment 545, a second transition segment 547, and a second end 548 that is mounted in a second aperture in the printed circuit board 530. As shown in FIG. 23, the ends of the generally vertical segment 543 are directly connected to the first end 542 of the wire 541 and to the first transition segment 544, respectively. The ends of the generally horizontal segment 545 are directly connected to the first transition segment 544 and to the generally U-shaped projection segment 546, respectively. The ends of the generally U-shaped projection segment 546 are directly connected to the generally horizontal segment 545 and to the second transition segment 547. The second transition segment is directly connected to the second end 548 of the wire 541. The first and second ends 542, 548 may be press-fit into their respective apertures in the printed circuit board 530 or mounted in the printed circuit board 530 by other means known to those of skill in the art.

As noted above, and as shown in FIG. 23, each of the wires 541 forms a "skeletal" plug blade 540. By "skeletal" it is meant that the plug blade 540 has an outer skeleton and a hollow or open area in the center. For example, as shown in FIG. 23, each wire 541 defines an outer perimeter or shell of the plug blade. However, in contrast to traditional plug blades for RJ-45 style plugs, each blade 541 has an open interior. The use of such skeletal plug blades 540 may facilitate reducing crosstalk levels between adjacent plug blades 540.

The plug blades 540 are generally aligned in side-by-side fashion to provide a row of plug blades 540. Each of the plug blades 540 is a planar blade that is positioned parallel to the longitudinal axis P of the plug 500 (see FIG. 21). As shown in FIG. 23, the generally horizontal segment 545 and the upper portion of the generally U-shaped projection segment 546 together form a top surface 549 of each plug blade 540. This top surface 549 may be generally parallel to a top surface of the printed circuit board 530. As shown in FIG. 23, as a result of the U-shaped projection segment 546, the top surface 549 of each plug blade 540 has a length $L_1$ which is greater than the distance $L_2$ between the first end 542 and the second end 548 of each wire 541.

As is also shown in FIG. 23, the U-shaped projection segments 546 on adjacent plug blades 540 are generally parallel to each other, but are offset from each other along the longitudinal axis P and point in opposite directions. For example, in FIG. 22, the U-shaped projection 546 on the right-most plug blade 540 points toward the rear of the plug 500, while the U-shaped projection 546 on the plug blade 540 next to the right-most plug blade 540 points toward the front of the plug 500. As a result, the first ends 542 of the first, third, fifth and seventh wires 541 in the row of plug blades are aligned in a first row, and the first ends 542 of the second, fourth, sixth and eighth wires 541 are aligned in a second row that is offset from the first row. Similarly, the second ends 548 of the first, third, fifth and seventh wires 541 are aligned in a third row, and the second ends 548 of the second, fourth, sixth and eighth wires 541 are aligned in a fourth row that is offset from the third row. This arrangement may also reduce the amount of overlap between adjacent plug blades 540, which may facilitate reducing crosstalk.

As is shown in FIGS. 22 and 24, a plurality of output contacts 542 are mounted at the rear of printed circuit board 530. In the particular embodiment of FIGS. 21-24, a total of eight output contacts 542 are mounted on the printed circuit board 530, with four of the output contacts 542 mounted on the top surface of printed circuit board 530 and the remaining four output contacts 542 mounted on the bottom surface of printed circuit board 530. In this embodiment, each output contact 542 is implemented as an insulation piercing contact 542 that includes a pair of sharpened triangular cutting surfaces. The respective top and bottom surfaces of the board edge termination assembly 550 each have a plurality of conductor tracks 555. Each conductor track 555 may be implemented, for example, as a generally rounded channel in a surface of the board edge termination assembly 550. Each conductor track 555 facilitates guiding a respective one of the eight insulated conductors of the communications cable that is to be attached to the plug 500 so as to be in proper alignment for making electrical connection to a respective one of the insulation piercing contacts 542.

As is also shown in FIGS. 22 and 24, the conductor tracks 555 are arranged n pairs. The conductors of the communication cable (not shown in the figures) are likewise paired as four twisted pairs of conductors. Each pair of conductor tracks 555 carries the two conductors of a respective one of the twisted pairs of conductors of the communications cable. As shown in FIGS. 22 and 24, each pair of tracks 555 may be configured so that there is no separation between the two conductors of the twisted pair that are laid within the conductor tracks 555. This may facilitate better maintaining the impedance and transmission performance of the twisted pair of conductors of the communications cable.

As is also shown in FIGS. 22 and 24, the top and bottom surfaces of the board edge termination assembly 550 may include horizontal surfaces 552 and 553, respectively, which are positioned just forward of the conductor tracks 555. During assembly of the plug 500, the conductors of the communication cable may be laid in the conductor tracks 555. Typically, the end of each conductor would extend beyond the front end of its respective conductor track 555 toward the plug blades 540. These horizontal surfaces 552 and 553 may serve as cutting surfaces during the assembly of the plug 500. In particular, a knife or other cutting tool may cut the ends off of the conductors of the communications cable using the horizontal surfaces 552 and 553 as a cutting anvil.

As is further shown in FIGS. 22 and 24, each conductor track 555 includes an opening 556 therein, and a respective one of the insulation piercing contacts 542 extends though each opening 556 so that the insulation piercing contact 542 can engage a respective one of the insulated conductors of the communications cable (not shown in the figures). Each insulation piercing contact 542 thus is longitudinally aligned along the longitudinal axis P with its respective insulated conductor of the communications cable. When the insulated conductor is pressed against its respective insulation piercing contact 542, the sharpened triangular cutting surfaces pierce the insulation of the insulated conductor to make physical and electrical contact with the conductor. Each insulation piercing contact 542 includes a pair of base posts that are mounted in, for example, metal plated apertures in the printed circuit board 530. At least one of the base posts of each insulation piercing output contact 542 may be electrically connected to a conductive path (not shown in FIGS. 21-24) on the printed circuit board 530. These conductive paths may be used to electrically connect each of the insulation piercing contacts 542 to a respective one of the plug blades 540. Thus, the insulation piercing contacts 542 and the conductive paths electrically connect each plug blade 540 to a respective conductor of a communications cable that connects to the back end of the communications plug 500.

In the particular embodiment of the present invention depicted in FIGS. 21-24, the insulation piercing contacts 542 are arranged in pairs (with each pair corresponding to one of the twisted differential pairs of conductors in the communications cable that is connected to plug 500. The insulation piercing contacts 542 of each pair are offset slightly, and the pairs are substantially transversely aligned. As noted above, four of the insulation piercing contacts 542 are provided on the top surface of the printed circuit board 530, while the remaining four insulation piercing contacts 542 are provided on the bottom surface of printed circuit board 530. This arrangement may facilitate reducing crosstalk between the four differential pairs as well as reducing alien NEXT. It will be appreciated that the output contacts need not be insulation piercing contacts 542. For example, in other embodiments, the output contacts could comprise conventional insulation displacement contacts (IDCs).

As noted above, a conductive path extends between each plug blade 540 and a respective one of the output contacts 542. Each conductive path may comprise, for example, one or more conductive traces that are provided on one or more layers of the printed circuit board 530. When a conductive path includes conductive traces that are on multiple layers of the printed circuit board 530, metal-plated or metal-filled through holes (or other layer-transferring structures known to those skilled in this art) may be provided that provide an electrical connection between the conductive traces on different layers of the printed circuit board 530.

The board edge termination assembly 550 is best illustrated in FIGS. 22 and 24. The board edge termination assembly 550 mates with the printed circuit board 530 to electrically connect the conductors of a communications cable to the printed circuit board 530. The board edge termination assembly 550 may be formed of, for example, polycarbonate, ABS, ABS/polycarbonate blend or like dielectric molded materials. The board edge termination assembly 550 includes a body 560 that has an opening 562 in a front surface thereof that is sized to receive the rear end of the printed circuit board 530. A separator 566 extends from the rear end of the body 560. This separator 566 may be received within the jacket of a communications cable (not shown in FIGS. 21-24) that is attached to the plug 500. As discussed above with respect to FIG. 3, the communications cable may include eight insulated conductors which are arranged as four twisted differential pairs. The separator 566 has four quadrants, each of which receives one of the four twisted differential pairs of conductors contained within the communications cable.

As is further shown in FIGS. 22 and 24, the top and bottom surfaces of the body 560 include pair channels 570. Each of these channels 570 connects one of the quadrants of the separator 566 to a pair of the conductor tracks 555. In regular use, the end portions of the conductors of each of the differential pairs of a communications cable that is attached to communications plug 500 are untwisted and routed through a respective one of the channels 570, and the conductors are then each placed above (or below) a respective one of the conductor tracks 555. A special tool (not shown) may then be used to push each conductor of the cable onto its respective insulation piercing contact 542 (or this can also be done by hand) in order to electrically connect each conductor to its respective insulation piercing contact 542.

Once the conductors of the communication cable are connected to their respective insulation piercing contact, the board termination assembly 550 may be inserted within the housing 510 of plug 500. The rear cap 528 may be removed from the housing 510 and placed over the communication cable before the individual conductors are mounted onto the board edge termination assembly 550. Once the board edge termination assembly 550 has been placed inside the housing 510, the rear cap 528 is moved along the cable to the end of the cable where it is snapped into place at the rear face 518 of the housing 510.

A strain relief mechanism (not shown) may be placed on the end of the communications cable that engages the jacketed cable and holds it in place against the separator 566. The strain relief mechanism may comprise, for example, a compressible wedge collar that surrounds and pinches against the jacketed cable.

Figure 25:
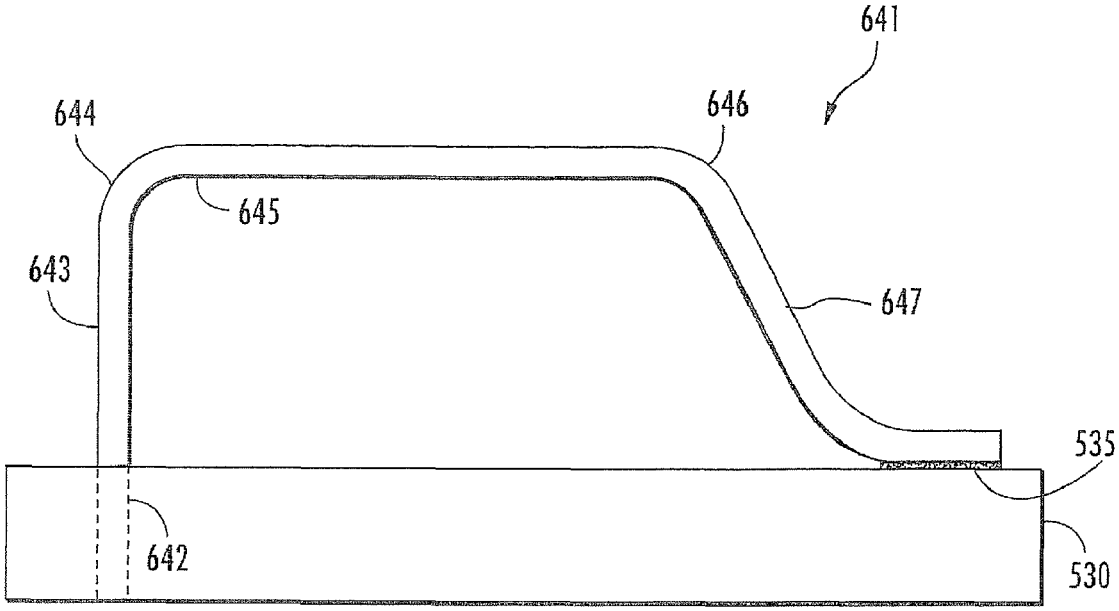
FIG. 25 is a side view of a plug blade according to further embodiments of the present invention that may be used in the communications plug of FIG. 21.

FIG. 25 is a side view of a skeletal blade 640 according to further embodiments of the present invention. The skeletal plug blades 640 could be used, for example, in place of the skeletal plug blades 540 described above with respect to FIGS. 21-24. As shown in FIG. 25, a wire 641 is used to form the skeletal plug blade 640. The wire 641 may have a shape similar to the shape of the wire 541 illustrated in FIG. 23. In particular, as shown in FIG. 25, each wire 641 includes a first end 642 that is mounted in a first aperture in the printed circuit board 530, a generally vertical segment 643 that extends from the aperture in the printed circuit board that holds the first end 642, a first transition segment 644 which may be implemented as a generally ninety degree bend, a generally horizontal segment 645, a second transition segment 646 which extends from an end of the generally horizontal segment 645, and a distal end segment 647 which bends toward the top surface of the printed circuit board 530.

As is also shown in FIG. 25, the distal end 647 of wire 641 may, in some embodiments, mate with a contact pad or other conductive surface 535 on the top surface of the printed circuit board 530. The contact between the contact pad 535 and the distal end 647 of wire 641 may be a compression contact in that the force exerted by a mating jack contact wire on the plug blade 640 may exert a force on the distal end 647 of wire 641 that holds the distal end 647 against the contact pad 535. The distal end 647 may also undergo a wiping action against the contact pad 535 when the plug that includes plug blades 640 is inserted into a jack. The contact pad 535 may be connected to conductive traces (not shown) on or within the printed circuit board 530. The first end 642 of wire 641 may be press-fit into its aperture in the printed circuit board 530 or mounted in the printed circuit board 530 by other means known to those of skill in the art. It will also be appreciated that, in some embodiments, neither end of the wire 641 may be mounted in the printed circuit board 530, and instead one or more contact pad connections may be used to electrically connect the wire 641 to conductive elements on the printed circuit board 530.

Each of the eight plug blades in the plug 500 of FIGS. 21-24 may alternatively be implemented using the plug blade 640. These eight plug blades 640 may be arranged in a side-by-side relationship to provide a row of plug blades 640. Each of the plug blades 640 may be positioned parallel to the longitudinal axis P of the plug 500 (see FIG. 21). Moreover, as discussed above with respect to the embodiment of FIGS. 21-24, adjacent of the plug blades 640 may be mounted to extend in opposite directions. Thus, the distal ends 647 of adjacent plug blades 640 may be generally parallel to each other, but be offset from each other along the longitudinal axis P and point in opposite directions. As a result, the first ends 642 of the first, third, fifth and seventh wires 641 in the row of plug blades may be aligned in a first row, and the first ends 642 of the second, fourth, sixth and eighth wires 641 may be aligned in a second row that is offset from the first row. Similarly, the distal ends 647 of the first, third, fifth and seventh wires 641 may be aligned in a third row, and the distal ends 648 of the second, fourth, sixth and eighth wires 641 may be aligned in a fourth row that is offset from the third row. This arrangement may reduce the amount of overlap between adjacent plug blades 640, which may facilitate reducing crosstalk.

As discussed above, in some embodiments of the communications jacks of the present invention (see FIGS. 4-10), contact pads are used as the output contacts, and the board edge termination assembly in such embodiments may include a plurality of contact members. In other embodiments of the communications jacks of the present invention (see FIGS. 12-14), insulation piercing contacts are used as the output contacts, and the contact members may be omitted from the board edge termination assembly in such embodiments. FIGS. 15-20 and FIGS. 21-24 provide examples of communications plugs that use insulation piercing contacts as the output contacts and which omit contact members from the board edge termination assembly. Thus, the embodiments of FIGS. 15-20 and FIGS. 21-24 may be viewed as communications plugs that use the principals of the communications jack of FIGS. 12-14. It will likewise be appreciated that communications plugs may also be provided that follow the principals of the communications jack of FIGS. 4-10.

In particular, according to still further embodiments of the present invention, the communication plug depicted in FIGS. 15-20 could be modified to use contact pads (such as the contact pads 191-198 of the embodiment of FIGS. 4-10) as the output contacts 442 on printed circuit board 430 instead of insulation piercing contacts. In this modified embodiment, the pivotable caps 470, 472 may be modified to have a configuration substantially like pivotable caps 150, 152 of the board edge termination assembly 130 of FIGS. 4-10. The communications plugs according to this alternative embodiment may likewise include a plurality of contact members that are mounted in the pivotable caps. These contact members, may, for example, have a configuration similar to the configuration of contact members 181-188 (see FIGS. 4-10). However, as the board edge termination assembly for a communications plug would typically be smaller than the corresponding board edge termination assembly for a communications jack (as plugs are typically smaller than jacks), the contact members 181-188 of FIGS. 4-10 may be modified to include a different type of wire connection terminal than an IDC as is used in contacts 181-188, such as, for example, an open cylindrical section that is designed to receive a non-insulated conductor and which can be crushed about the conductor.

Since this alternative communications plug design uses surface mount contact pads as the output contacts 442, the base pillars that are present on the insulation piercing contacts 442 of FIGS. 15-20 are no longer necessary. As these base pillars may extend all the way through the printed circuit board 430, they can render a significant portion of the printed circuit board 430 un-useable for the conductive paths and/or for crosstalk compensation structures. Thus, these alternate embodiments of the communications plugs of the present invention may make it easier to route conductive paths on the printed circuit board.

The skilled artisan will recognize numerous modifications may be made to the above described communications jacks, plugs and board edge termination assemblies without departing from the spirit or scope of the present invention. For example, although the communications jacks and plugs illustrated and described herein are configured to communicate communication signals over four differential pairs (i.e., eight wires), communications jacks and plugs that are configured to accommodate other numbers of differential pairs may also be used.

Further, those skilled in this art will recognize that the bodies of board edge termination assemblies 130, 330, 450, 550 may be modified in numerous ways. For example, the pivotable caps thereon could be replaced with caps that are separate pieces that are not connected by hinges to the body of the board edge termination assembly. In some embodiments, the caps could be omitted. Thus, it will be appreciated that the foregoing description is illustrative of the present invention and is not to be construed as limiting thereof.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications plug, comprising:

a printed circuit board having a top side and a bottom side;

a housing that receives at least a portion of the printed circuit board;

first through eighth skeletal plug blades mounted on the printed circuit board;

first through eighth insulation piercing contacts mounted on the printed circuit board; and a board edge termination assembly that includes an opening that receives an edge of the printed circuit board, the board edge termination assembly comprising a body that is configured to receive at least eight conductors of a communications cable and to electrically connect the eight conductors to respective ones of the first through eighth insulation piercing contacts;

wherein each skeletal plug blade comprises a wire having first and second ends that are each mounted in the printed circuit board.

2. The communications plug of claim 1, wherein four of the first through eighth insulation piercing contacts are mounted on the top side of the printed circuit board and the remaining four of the first through eighth insulation piercing contacts are mounted on the bottom side of the printed circuit board.

3. The communications plug of claim 1, wherein each wire further includes:

a generally vertical segment;

a generally horizontal segment;

a first transition segment;

a generally U-shaped projection segment; and a second transition segment;

wherein ends of the generally vertical segment are directly connected to the first end of the wire and to the first transition segment, respectively;

wherein ends of the generally horizontal segment are directly connected to the first transition segment and to the generally U-shaped projection segment, respectively; and wherein ends of the generally U-shaped projection segment are directly connected to the generally horizontal segment and to the second transition segment.

4. The communications plug of claim 1, wherein a length of each respective skeletal plug blade in a longitudinal direction of the plug exceeds a longitudinal distance between a first end and a second end of each respective plug blade.

5. The communications plug of claim 1, wherein the board edge termination assembly includes a first pivotable cap and a second pivotable cap, wherein the first pivotable cap is connected to the body by a first hinge and the second pivotable cap is connected to the body by a second hinge.

6. The communications plug of claim 1, wherein the board edge termination assembly includes a track that is configured to receive two of the eight conductors of the communications cable, wherein the track includes an opening, and at least two of the insulation piercing contact extend through the opening.

7. The communications plug of claim 1, wherein the eight conductors of the communications cable are arranged as four differential pairs of conductors, and wherein the board edge termination assembly includes first through fourth tracks, each of which is configured to receive a respective one of the four differential pairs conductors therein.

8. The communications plug of claim 1, wherein a first side of each skeletal plug blade includes a projection in a direction parallel to the plane defined by the top side of the printed circuit board.

9. The communications plug of claim 8, wherein the projections on adjacent blades extend in parallel but opposite directions.

10. A communications plug, comprising:

a printed circuit board having a top side and a bottom side;

a housing that receives at least a portion of the printed circuit board;

first through eighth skeletal plug blades mounted on the printed circuit board;

first through eighth insulation piercing contacts mounted on the printed circuit board; and a board edge termination assembly that includes an opening that receives an edge of the printed circuit board, the board edge termination assembly comprising a body that is configured to receive at least eight conductors of a communications cable and to electrically connect the eight conductors to respective ones of the first through eighth insulation piercing contacts;

wherein each skeletal plug blade comprises a wire having first and second ends, and wherein at least one of the first and second ends is positioned to make a wiping contact with a respective conductive element of the printed circuit board.

11. The communications plug of claim 10, wherein the board edge termination assembly further includes a separator that is configured to be inserted into the jacket of the communication cable.

12. The communications plug of claim 10, wherein the board edge termination assembly includes a track for at least one of the eight conductors of the communications cable, wherein the track includes an opening, and wherein at least one insulation piercing contact extends through the opening.

13. The communications plug of claim 10, wherein the body of the board edge termination assembly comprises a non-conductive body that has a top side and a bottom side, and wherein the body includes a horizontal surface on at least one of the top and the bottom sides that is configured to function as an anvil to cut off the ends of at least some of the conductors of the communications cable.

14. A communications plug, comprising:

a printed circuit board having a top side and a bottom side;

a housing that receives at least a portion of the printed circuit board;

first through eighth skeletal plug blades mounted on the printed circuit board;

first through eighth insulation piercing contacts mounted on the printed circuit board; and a board edge termination assembly that includes an opening that receives an edge of the printed circuit board, the board edge termination assembly comprising a body that is configured to receive at least eight conductors of a communications cable and to electrically connect the eight conductors to respective ones of the first through eighth insulation piercing contacts;

wherein at least one end of each skeletal plug blade contacts the printed circuit board via a compression contact that is not inserted within an aperture in the printed circuit board.

15. A communications plug, comprising:

a printed circuit board having a top side and a bottom side;

a housing that receives at least a portion of the printed circuit board;

first through eighth skeletal plug blades mounted on the printed circuit board;

first through eighth insulation piercing contacts mounted on the printed circuit board; and a board edge termination assembly that includes an opening that receives an edge of the printed circuit board, the board edge termination assembly comprising a body that is configured to receive at least eight conductors of a communications cable and to electrically connect the eight conductors to respective ones of the first through eighth insulation piercing contacts;

wherein the first through eighth skeletal plug blades comprise first through eighth wires that are bent to form plug blades, wherein the skeletal plug blades are generally aligned in side-by-side fashion in numerical order, wherein first ends of each of the first, third, fifth and seventh wires are aligned in a first row, wherein first ends of each of the second, fourth, sixth and eighth wires are aligned in a second row, wherein second ends of each of the first, third, fifth and seventh wires are aligned in a third row, wherein second ends of each of the second, fourth, sixth and eighth wires are aligned in a fourth row, and wherein the first, second, third and fourth rows are offset from each other.

16. A communications plug, comprising:

a printed circuit board having a top side and a bottom side;

first through eighth elongated skeletal plug blades, wherein each skeletal plug blade comprises a wire having a first end mounted in a respective one of first through eighth openings in the top side of the printed circuit board and a second end; and first through eighth insulation piercing contacts that are mounted directly into the printed circuit board, wherein four of the first through eighth insulation piercing contacts are mounted to extend above the top side of the printed circuit board and the remaining four of the first through eighth insulation piercing contacts are mounted to extend below the bottom side of the printed circuit board;

wherein the first through eighth insulation piercing contacts include at least one sharpened triangular cutting surface.

17. The communications plug of claim 16, wherein the communications plug further includes a board edge termination assembly that at least partially surrounds the printed circuit board, the board edge termination assembly including first through eighth apertures, wherein each insulation piercing contact extends through a respective one of the first through eighth apertures.

18. The communications connector of claim 16, wherein each wire further includes:

a generally vertical segment;

a generally horizontal segment;

a first transition segment;

a generally U-shaped projection segment; and a second transition segment;

wherein ends of the generally vertical segment are directly connected to the first end of the wire and to the first transition segment, respectively;

wherein ends of the generally horizontal segment are directly connected to the first transition segment and to the generally U-shaped projection segment, respectively; and wherein ends of the generally U-shaped projection segment are directly connected to the generally horizontal segment and to the second transition segment.

19. The communications connector of claim 16, wherein a first side of each skeletal plug blade is substantially normal to the printed circuit board and a second side of each skeletal plug blade that is opposite the first side includes a projection in a direction parallel to the plane defined by the top side of the printed circuit board.

20. The communications connector of claim, 19, wherein the projections on adjacent skeletal plug blades extend in parallel but opposite directions.

21. The communications plug of claim 16, wherein the first through eighth skeletal plug blades are mounted in side-by-side fashion in numerical order such that at least a part of each skeletal plug blade is misaligned with respect to an adjacent skeletal plug blade.

22. The communications plug of claim 21, wherein the first, third, fifth and seventh plug blades are aligned in a first row, and the second, fourth, sixth and eighth skeletal plug blades are aligned in a second row that is at least partially offset from the first row.

23. The communications plug of claim 21, wherein each of the first through eighth plug blades have substantially the same shape.

24. A communications plug, comprising;

a printed circuit board having a top side and a bottom side;

first through eighth skeletal plug blades, wherein each skeletal plug blade comprises a wire having a first end mounted in a respective one of first through eighth openings in the top side of the printed circuit board and a second end; and first through eighth insulation piercing contacts mounted on the printed circuit board, wherein four of the first through eighth insulation piercing contacts are mounted on the top side of the printed circuit board and the remaining four of the first through eighth insulation piercing contacts are mounted on the bottom side of the printed circuit board;

wherein the second end of each wire is mounted in a respective one of ninth through sixteenth openings in the top side of the printed circuit board.

25. A communications plug, comprising:

a printed circuit board;

a skeletal blade comprising a wire having a first end that is received within a first aperture in the printed circuit board and a second end that is received within a second aperture in the printed circuit board; and an insulation piercing contact that is mounted on the printed circuit board and that is electrically connected to the skeletal plug blade through a conductive path in the printed circuit board;

wherein the skeletal plug blade is configured to mate with a contact of a mating communications jack; and wherein at least one of the first end and the second end is electrically connected to a conductive element in the printed circuit board.

26. The communications plug of claim 25, wherein the wire is shaped so that the blade includes a projection in a direction parallel to a plane defined by a top side of the printed circuit board.

27. The communications plug of claim 25, wherein the length of the blade in a longitudinal direction of the printed circuit board exceeds the distance between the first end and the second end.

28. A communications plug, comprising:

a printed circuit board;

a skeletal blade comprising a wire having a first end that is received within a first aperture in the printed circuit board and a second end that is received within a second aperture in the printed circuit board wherein the skeletal plug blade is configured to mate with a contact of a mating communications jack; and wherein at least one of the first end and the second end is electrically connected to a conductive element in the printed circuit board;

wherein the first end and the second end are configured to be either press fit or soldered into the first and second apertures in the printed circuit board, respectively.

29. A communications plug, comprising;

a printed circuit board; and a skeletal blade comprising a wire having a first end that is electrically connected to the printed circuit board via a first contact pad and a second end that is electrically connected to the printed circuit board via a second contact pad; and an insulation piercing contact that is mounted on the printed circuit board and that is electrically connected to the skeletal plug blade through a conductive path in the printed circuit board.

* * * * *